US010244907B2

(12) United States Patent
Jang et al.

(10) Patent No.: US 10,244,907 B2
(45) Date of Patent: Apr. 2, 2019

(54) CLEANING APPARATUS

(71) Applicant: LG ELECTRONICS INC., Seoul (KR)

(72) Inventors: Jaewon Jang, Seoul (KR); Jeongyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 721 days.

(21) Appl. No.: 14/834,013

(22) Filed: Aug. 24, 2015

(65) Prior Publication Data

US 2016/0051103 A1 Feb. 25, 2016

(30) Foreign Application Priority Data

Aug. 25, 2014 (KR) ..... 10-2014-0110774
Mar. 6, 2015 (KR) ..... 10-2015-0031467
Apr. 6, 2015 (KR) ..... 10-2015-0048292

(51) Int. Cl.

| | |
|---|---|
| ***A47L 5/24*** | (2006.01) |
| ***A47L 5/28*** | (2006.01) |
| ***A47L 5/22*** | (2006.01) |
| ***A47L 9/32*** | (2006.01) |
| ***A47L 9/28*** | (2006.01) |
| ***A47L 9/00*** | (2006.01) |
| ***A47L 9/24*** | (2006.01) |
| ***B25G 1/04*** | (2006.01) |
| ***B25G 3/18*** | (2006.01) |

(52) U.S. Cl.

CPC ..... *A47L 5/28* (2013.01); *A47L 5/225* (2013.01); *A47L 5/24* (2013.01); *A47L 9/009* (2013.01); *A47L 9/246* (2013.01); *A47L 9/2884* (2013.01); *A47L 9/325* (2013.01); *B25G 1/04* (2013.01); *B25G 3/18* (2013.01); *A47L 2201/00* (2013.01); *A47L 2201/02* (2013.01)

(58) Field of Classification Search

CPC ..... A47L 5/24; A47L 5/28; A47L 5/225
USPC ..... 15/350, 352, 353
See application file for complete search history.

(56) References Cited

U.S. PATENT DOCUMENTS

| | | | | |
|---|---|---|---|---|
| 5,309,600 | A | 5/1994 | Weaver et al. | |
| 8,801,861 | B2 | 8/2014 | Cobabe et al. | |
| 9,962,049 | B2 * | 5/2018 | Thorne | A47L 5/28 |
| 2007/0094839 | A1 * | 5/2007 | Zahuranec | A47L 5/28 15/328 |

(Continued)

FOREIGN PATENT DOCUMENTS

| | | |
|---|---|---|
| CN | 101583302 A | 11/2009 |
| CN | 102655798 A | 9/2012 |

(Continued)

*Primary Examiner* — Michael Jennings
(74) *Attorney, Agent, or Firm* — Dentons US LLP

(57) ABSTRACT

A cleaning apparatus is provided. The cleaning apparatus includes a cleaning unit including a power consumption unit and a stick unit with which the cleaning unit is coupled and which allows the cleaning unit to move in a state of being gripped by a user. The cleaning unit includes a first coupling portion, and the stick unit includes a second coupling portion separably coupled with the first coupling portion, an operation portion operable to separate the second coupling portion from the first coupling portion, and a power transfer portion for transferring an operation force of the operation portion to the second coupling portion.

19 Claims, 39 Drawing Sheets

(56) References Cited

U.S. PATENT DOCUMENTS

| | | | | |
|---|---|---|---|---|
| 2007/0136984 | A1* | 6/2007 | Hsu | A47L 5/225 15/339 |
| 2010/0083459 | A1* | 4/2010 | Beskow | A47L 5/225 15/353 |
| 2010/0115726 | A1* | 5/2010 | Groff | A47L 5/24 15/344 |
| 2010/0251506 | A1* | 10/2010 | Conrad | A47L 5/225 15/344 |
| 2011/0289719 | A1* | 12/2011 | Han | A47L 5/225 15/344 |
| 2012/0189507 | A1 | 7/2012 | Ko | |
| 2014/0237754 | A1* | 8/2014 | Conrad | A47L 5/225 15/328 |

FOREIGN PATENT DOCUMENTS

| | | | |
|---|---|---|---|
| CN | 102670138 | A | 9/2012 |
| DE | 3942267 | C1 | 1/1991 |
| EP | 1806084 | A2 | 7/2007 |
| EP | 2 494 899 | A2 | 9/2012 |
| JP | 2012-90762 | A | 5/2012 |
| KR | 10-1208979 | | 11/2012 |
| WO | 2006/066514 | A1 | 6/2006 |

* cited by examiner

CLEANING APPARATUS

CROSS-REFERENCE TO RELATED APPLICATION(S)

The present application claims priority under 35 U.S.C. 119 and 35 U.S.C. 365 to Korean Patent Application No. 10-2014-0110774 (filed on Aug. 25, 2014), Korean Patent Application No. 10-2015-0031467 (filed on Mar. 6, 2015), and Korean Patent Application No. 10-2015-0048292 (filed on Apr. 6, 2015), all of which are incorporated by reference in their entirety for all purposes as if fully set forth herein.

BACKGROUND

Field

The present disclosure herein relates to a cleaning apparatus.

Background

Cleaning apparatuses are apparatuses which suck dust using a suction force generated by a suction force generating device to clean a target area.

Korean Patent Publication No. 10-1208979 (registered on Nov. 30, 2012, hereinafter, referred to as a cited reference) discloses a separable robot cleaner.

The separable robot cleaner includes a body including driving wheels and a hand type cleaner separably coupled with the body.

The hand type cleaner includes a suction motor, a dust container, and a handle. Also, while the hand type cleaner is being coupled with the body, the body may automatically perform cleaning while moving. The hand type cleaner may be separated to independently perform cleaning.

In the case of the general separable robot cleaner, it is necessary to hold the hand type cleaner while the hand type cleaner is being separated. However, since the hand type cleaner includes the suction motor and the dust container, the hand type cleaner is heavy, which causes inconvenience of a user while cleaning.

Also, when the hand type cleaner is mounted on the body, the body only cleans while automatically moving but it is impossible for the user to clean while manually moving the body.

SUMMARY

The present invention provides a cleaning apparatus.

A cleaning apparatus according to an aspect is provided. The cleaning apparatus includes a cleaning unit including a power consumption unit and a first coupling protion; and a stick unit able to be coupled to the cleaning unit and which allows the cleaning unit to move when gripped by a user. The stick unit includes a second coupling portion able to be coupled with the first coupling portion, an operation portion operable to separate the second coupling portion from the first coupling portion, and a power transfer portion for transferring an operation force of the operation portion to the second coupling portion.

A cleaning apparatus according to another aspect includes a cleaning unit including a suction force generating device and a transport device for automatically moving and a stick unit separably coupled with the cleaning unit and able to move the cleaning unit when gripped by a user. The stick unit may include a battery for supplying power to the suction force generating device.

A cleaning apparatus according to still another aspect includes a first cleaning unit which includes a suction motor and a transport device for automatically moving, a stick unit separably connected to the first cleaning unit, and a second cleaning unit which is separably connected to the stick unit and includes a suction motor and a battery for supplying power to the suction motor.

The details of one or more embodiments are set forth in the accompanying drawings and the description below. Other features will be apparent from the description and drawings, and from the claims.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected," "coupled," and "joined" to the latter via another component.

Figure 1:
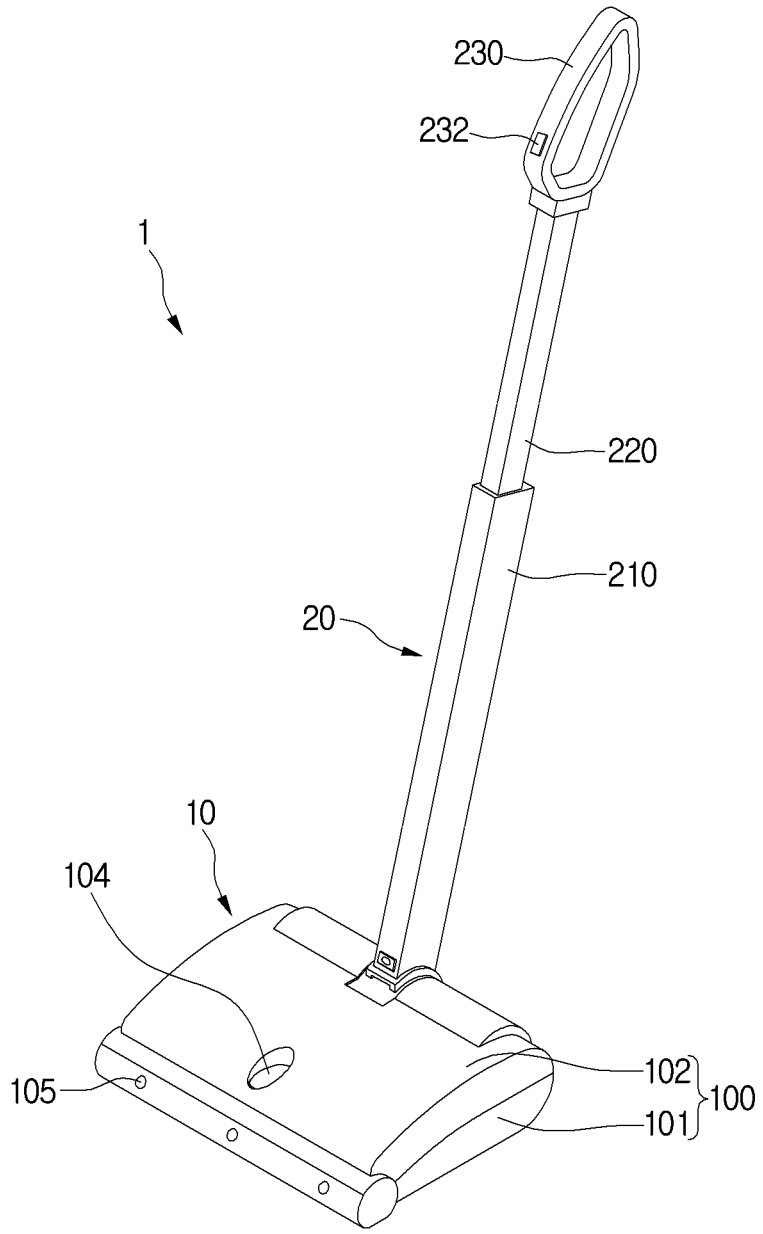
FIG. 1 is a perspective view of a cleaning apparatus according to a first embodiment.

FIG. 1 is a perspective view of a cleaning apparatus 1 according to a first embodiment.

Referring to FIG. 1, the cleaning apparatus 1 may include a cleaning unit 10 able to automatically move and a stick unit 20 separably coupled with the cleaning unit 10.

When the stick unit 20 is separated from the cleaning unit 10, the cleaning unit 10 may automatically perform cleaning a floor surface while moving.

When the stick unit 20 is connected with the cleaning unit 10, a user may perform cleaning the floor surface while manually moving the cleaning unit 10 using the stick unit 20.

The stick unit 20 may include stick bodies 210 and 220 and a handle 230 provided at one side of the stick bodies 210 and 220.

The stick bodies 210 and 220 may include a plurality of bodies slidably coupled. Accordingly, it is possible to adjust lengths of the stick bodies 210 and 220. For example, the stick bodies 210 and 220 may include a first body 210 and a second body 220 slidably connected to the first body 210. Also, the handle 230 may be provided at the second body 220.

Accordingly, when the stick unit 20 is connected with the cleaning unit 10, the user grips the handle 230 and moves the cleaning unit 10.

Here, when the stick unit 20 is connected with the cleaning unit 10, the cleaning unit 10 may be moved manually. That is, when the stick unit 20 is connected with the cleaning unit 10, the cleaning unit 10 moves forward or backward or rotates due to a pushing force, a pulling force, a rotating force transferred from the stick unit 20.

The stick unit 20 may further include an input unit 232 for inputting an operation command for the cleaning unit 10. The input unit 232, for example, may be provided on the handle 230.

The cleaning unit 10 may include a main body 100 in which a plurality of components are able to be accommodated. The main body 100 may include a plurality of bodies 101 and 102.

Although not limited, the plurality of bodies 101 and 102 may include a lower body 101 and an upper body 102.

The cleaning unit 10 may further include a user interface 104 which may receive a command of the user or may display information. The user interface 104, for example, may be located on a top of the main body 100 but is not limited thereto.

It is possible to input various commands such as a cleaning mode, a cleaning time, and a suction force level through the user interface 104.

Also, through the user interface 104, various types of information such as the cleaning time, the cleaning mode, a residual amount of power in a battery, and a sucked dust amount may be displayed.

The cleaning unit 10 may further include a sensing portion 105. The sensing portion 105 may be provided at one or more of a top, a bottom, and sides of the main body 100.

The sensing portion 105 may include one or more of a sensor for sensing obstacles, a sensor for sensing a shock, a sensor for sensing a stepped portion of a floor, a camera for taking a picture of the periphery of the cleaning unit 10, and a sensor for recognizing a position.

Hereinafter, the cleaning unit 10 will be described in more detail.

Figure 2:
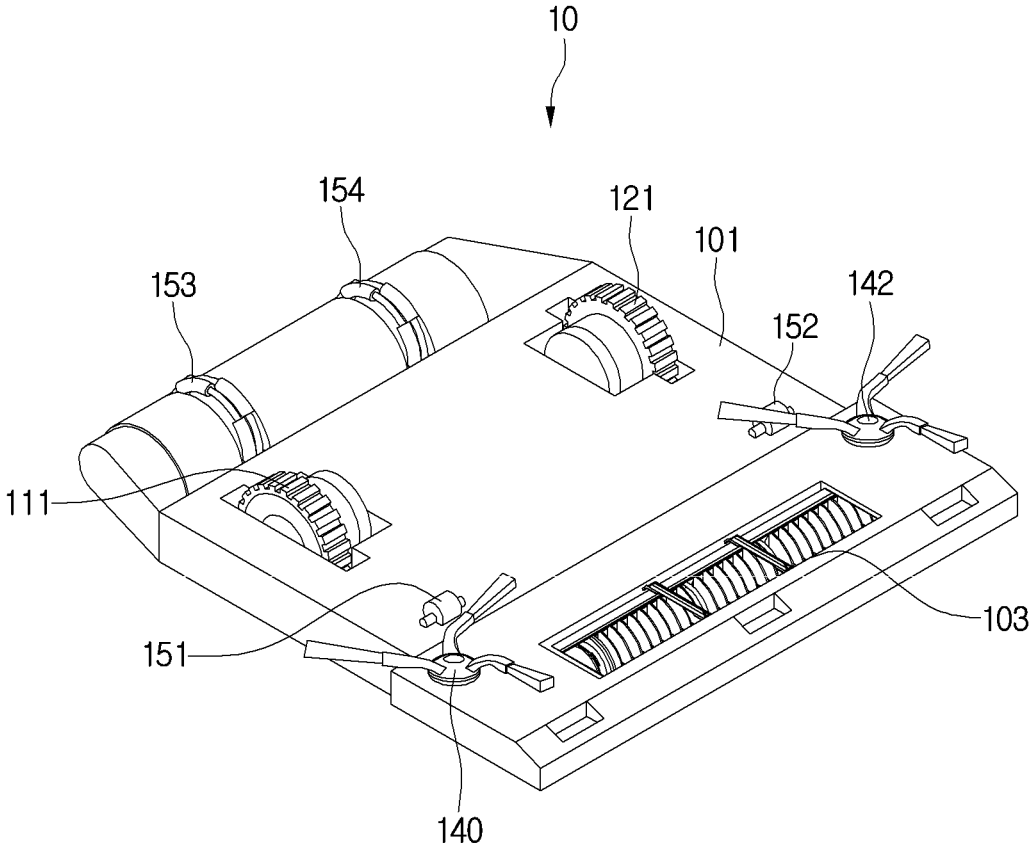
FIG. 2 is a perspective view illustrating a bottom of a cleaning unit according to the first embodiment.
Figure 3:
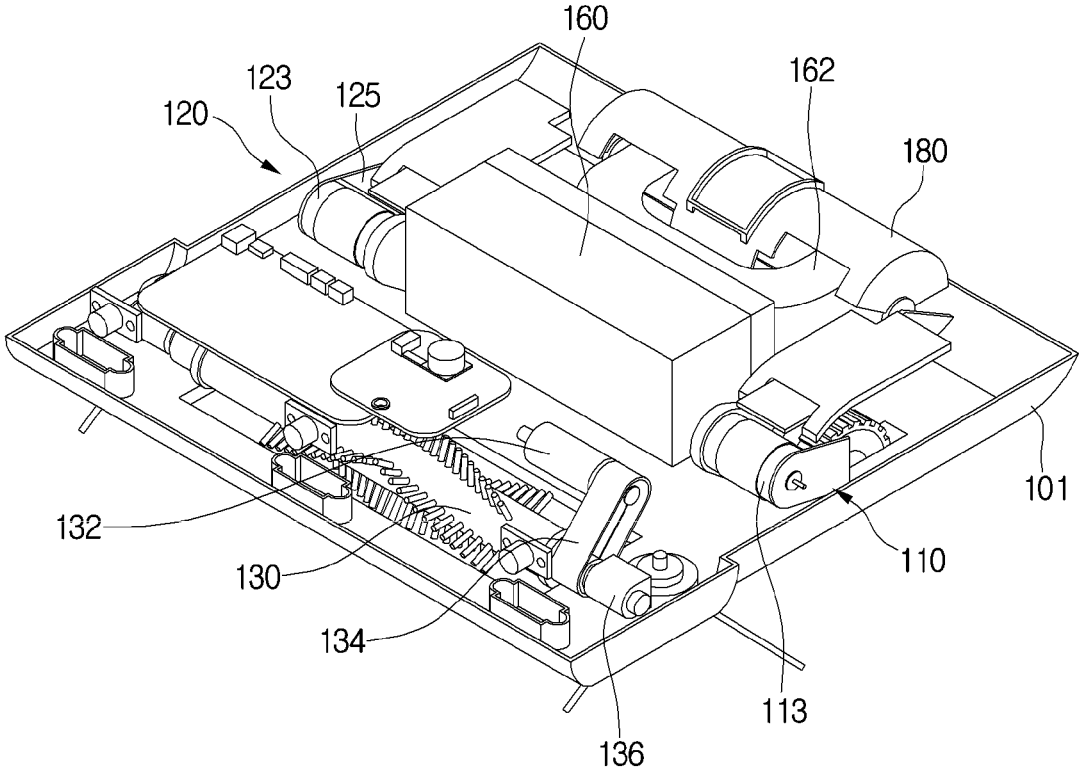
FIG. 3 is a perspective view illustrating an internal configuration of the cleaning unit according to the first embodiment.
Figure 4:
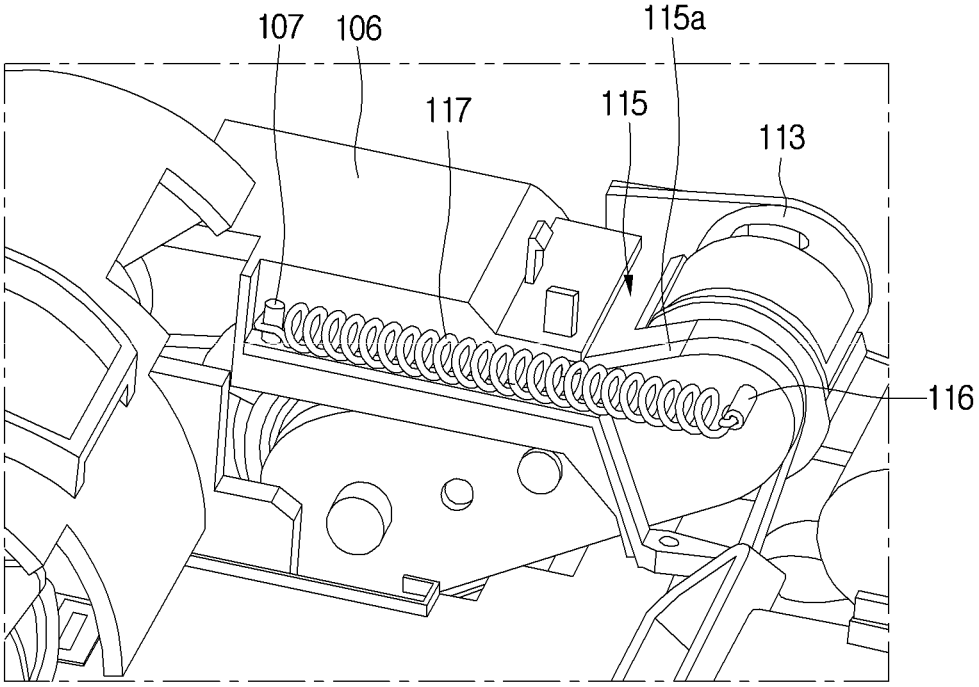
FIG. 4 is a perspective view of a transport device according to the first embodiment.

FIG. 2 is a perspective view illustrating a bottom of the cleaning unit 10 according to the first embodiment. FIG. 3 is a perspective view illustrating an internal configuration of the cleaning unit 10 according to the first embodiment. FIG. 4 is a perspective view of a transport device according to the first embodiment.

Referring to FIGS. 2 to 4, the cleaning unit 10 may further include transport devices 110 and 120 to allow the cleaning unit 10 to automatically move.

The transport devices 110 and 120 may include a first transport device 110 and a second transport device 120.

The first transport device 110 may include a first wheel 111, a first motor 113 for rotating the first wheel 111, and a first power transfer device 115 to transfer power of the first motor 113 to the first wheel 111.

The second transport device 120 may include a second wheel 121, a second motor 123 for rotating the second wheel 121, and a second power transfer device 125 to transfer power of the second motor 123 to the second wheel 121.

The respective motors 113 and 123 may be independently driven. Accordingly, due to the independent driving of the respective motors 113 and 123, the cleaning unit 10 may move forward or backward or rotate.

The respective motors 113 and 123 and power transfer devices 115 and 125 may be located inside the main body 100. The first wheel 111 and the second wheel 121 may penetrate the lower body 101 of the main body 100 and may be in contact with a floor surface.

Throughout the specification, the first transport device 110 and the second transport device 120 have the same structure. Accordingly, hereinafter, only the first transport device 110 will be described.

The first power transfer device 115 may include a plurality of gears to transfer the power of the first motor 113 to the first wheel 111. The plurality of gears may function as reducers.

The first power transfer device 115 may include a housing 115*a*, and the plurality of gears may be accommodated in the housing 115*a*. Alternatively, the first power transfer device 115 may include a plurality of pulleys and belts.

Also, the first motor 113 may be installed in the housing 115*a*.

Figure 6:
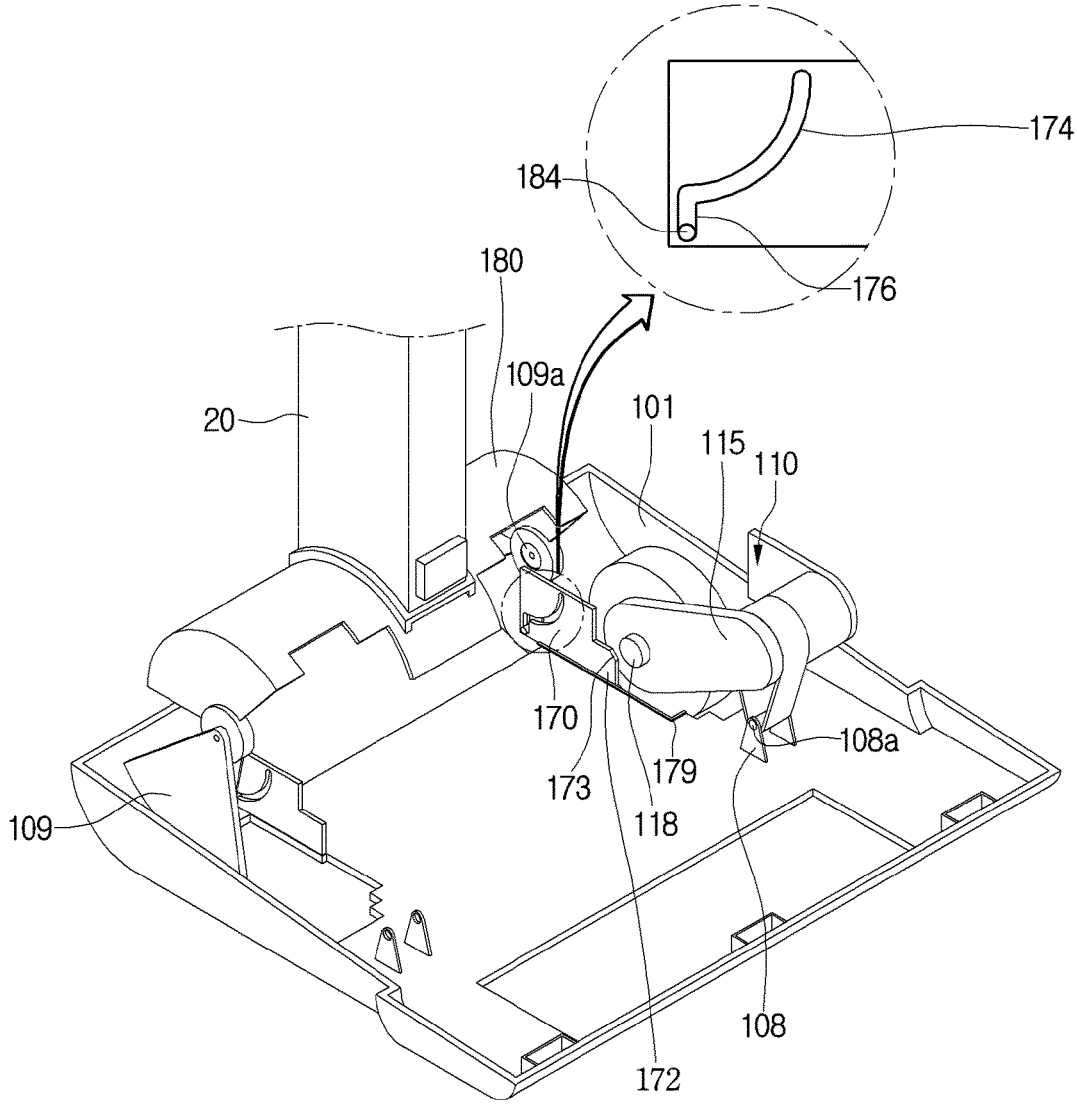
FIGS. 6 to 10 illustrate a state in which the transport device is lifted by a lifting device according the first embodiment.

The housing 115*a* may be pivotably coupled with a housing supporting portion 108 (refer to FIG. 6) included in the main body 100 using a hinge axis 108*a* (refer to FIG. 6).

Accordingly, the first power transfer device 115 may pivot on the hinge axis 108*a*, thereby allowing the first transport device 110 to pivot on the hinge axis 108*a*.

The first power transfer device 115 may be elastically supported by an elastic member 117. The elastic member 117 provides an elastic force for the first power transfer device 115 to allow the first wheel 111 connected with the first power transfer device 115 to move in a direction which becomes farther from the bottom of the main body 100 or toward the floor surface.

For example, in FIG. 4, as the first power transfer device 115 pivots counterclockwise, the first wheel 111 becomes farther from the bottom of the main body 100.

The housing 115*a* may include a second pin 116, and a frame 106 included in the main body 100 may include a first pin 107. Also, the elastic member 117 may be connected with the respective pins 107 and 116.

Here, the second pin 116 may be located above the hinge axis 108*a*. Accordingly, since the first pin 107 and the second pin 116 become closer to each other due to the elastic member 117, the first power transfer device 115 is to pivot counterclockwise based on FIG. 4.

As described above, since the first power transfer device 115 is supported by the elastic member 117, the first transport device 110 has a suspension effect, thereby increasing a frictional force between the floor surface and the first wheel 111 to improve the moving performance of the cleaning unit 10. That is, the first transport device 110 may have a suspension structure.

Also, due to the suspension structure of the first transport device 110, regardless of a state of the floor surface, the first wheel 111 may smoothly rotate, thereby improving the moving performance of the cleaning unit 10.

The lower body 101 of the main body 100 may include a suction hole 103 to suction air and dust.

Also, the cleaning unit 10 may further include a main brush 130 located adjacent to the suction hole 103 to clean the floor surface.

The main brush 130 may be located inside the main body 100 and a part thereof may penetrate the suction hole 103.

The cleaning unit 10 may include a brush motor 132 for rotating the main brush 130 and a power transfer portion 134 for transferring the power of the brush motor 132 to the main brush 130. The power transfer portion 134 may include a belt or one or more gears.

The cleaning unit 10 may further include one or more side brushes 140 and 142 installed at corners of the cleaning unit 10 to clean areas near the corners of the cleaning unit 10.

The one or more side brushes 140 and 142 may be rotatably installed on the bottom of the main body 100.

The one or more side brushes 140 and 142 may receive a rotating force of the main brush 130 through a power transfer portion 136. Also, the one or more side brushes 140 and 142 may be rotated by a side brush motor separate from the brush motor 132.

Also, the one or more side brushes 140 and 142 may receive the power of the brush motor 132 to be rotated.

The cleaning unit 10 may further include a dust container 160 in which the dust sucked through the suction hole 103 is stored.

Also, the cleaning unit 10 may further include a suction force generating device 162 connected with the dust container 160 to generate a suction force.

When the suction force generating device 162 operates, the air and dust sucked through the suction hole 103 flow into the dust container 160. Then, the dust which flows into the dust container 160 may be stored in the dust container 160, and the air may be discharged from the dust container 160 may pass the suction force generating device 162, and may be discharged outside the cleaning unit 10.

The cleaning unit 10 may further include a plurality of auxiliary wheels 151, 152, 153, and 154 to allow the cleaning unit 10 to easily move. Throughout the specification, the first wheel 111 and the second wheel 121 may be designated as main wheels.

In the specification, the cleaning unit 10 may include three or more auxiliary wheels and two of them may be spaced apart from each other toward a front and a rear of the cleaning unit 10.

In the specification, a direction of the front and rear of the cleaning unit 10 means a direction of forward and backward movement of the cleaning unit 10.

The plurality of auxiliary wheels 151, 152, 153, and 154 may be rotatably coupled with the main body 100. Also, the plurality of auxiliary wheels 151, 152, 153, and 154 may be rotated by friction with the floor surface.

The plurality of auxiliary wheels 151, 152, 153, and 154 may include one or more front wheels 151 and 152 and a plurality of rear wheels 153 and 154.

Alternatively, the plurality of auxiliary wheels 151, 152, 153, and 154 may include a plurality of front wheels 151 and 152 and one or more rear wheels 153 and 154.

When the stick unit 20 is separated from the cleaning unit 10, the first wheel 111 and the second wheel 121 are rotated by the power of the first motors 113 and the second motor 123, respectively, and the plurality of auxiliary wheels 151, 152, 153, and 154 may assist the rotation of the first wheel 111 and the second wheel 121.

When the stick unit 20 is separated from the cleaning unit 10, the first motor 113 and the second motor 123 may be stopped.

In this case, the rotation of the first wheel 111 and the second wheel 121 may be stopped and the cleaning unit 10 may be moved by the plurality of auxiliary wheels 151, 152, 153, and 154. The movement of the cleaning unit 10 through the plurality of auxiliary wheels 151, 152, 153, and 154 will be described below.

The cleaning unit 10 may further include a connecting member 180 with which the stick unit 20 is connected. The connecting member 180 may be rotatably connected to the main body 100.

Figure 5:
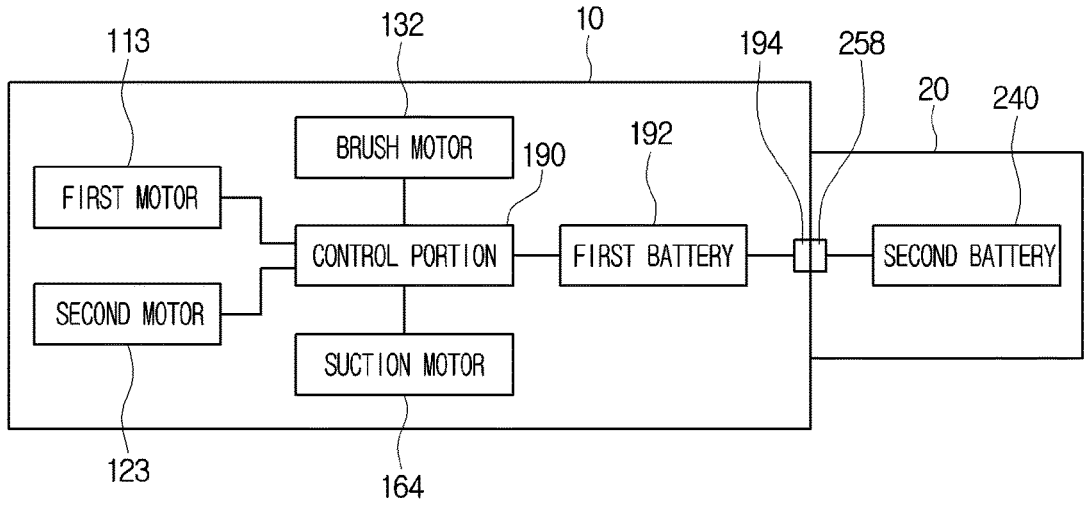
FIG. 5 is a block diagram illustrating a configuration of the cleaning apparatus according to the first embodiment.

FIG. 5 is a block diagram illustrating a configuration of the cleaning apparatus 1 according to the first embodiment.

Referring to FIG. 5, the cleaning unit 10 may further include a first battery 192 for supplying power to the suction force generating device 162, the brush motor 132, and the first motor 113 and the second motor 123.

The cleaning unit 10 may further include a control portion 190. The control portion 190 may control the suction force generating device 162, the brush motor 132, the first motor 113, and the second motor 123.

Although not limited, the first battery 192 may be disposed between the dust container 160 and the suction force generating device 162.

The suction force generating device 162 may include, for example, a suction motor 164.

The stick unit 20 may further include a second battery 240 for supplying power to the cleaning unit 10.

The cleaning unit 10 may include a first terminal 194, and the stick unit 20 may include a second terminal 258 connected to the first terminal 194. For example, the first terminal 194 may be included in the connecting member 180.

The first terminal 194 and the second terminal 258 may be electrically connected to each other. Accordingly, when the first terminal 194 and the second terminal 258 are connected to each other, the power of the second battery 240 may be supplied to the cleaning unit 10.

Here, an internal circuit of the cleaning unit 10 may be designed to allow the first battery 192 and the second battery 240 to be connected in series when the second terminal 258 is connected to the first terminal 194.

Accordingly, since the plurality of batteries 192 and 240 are connected in series when the stick unit 20 is connected to the cleaning unit 10, the suction motor 164 may receive high voltage. Since the suction motor 164 receives the high voltage, the suction motor 164 may output high power.

Also, since the plurality of batteries 192 and 240 are connected in series when the stick unit 20 is connected to the cleaning unit 10, an operation time of the cleaning unit 10 may increase.

The control portion 190 may sense whether the first terminal 194 and the second terminal 258 are connected and may control operations of the first motor 113 and the second motor 123 depending on whether the first terminal 194 and the second terminal 258 are connected.

For example, when the control portion 190 recognizes that the first terminal 194 is separated from the second terminal 258, the control portion 190 may control the first motor 113 and the second motor 123 to be in an operable state. In this state, when a cleaning start command is input through the user interface 104, the control portion 190 may drive the first motor 113 and the second motor 123. Then, the cleaning unit 10 may automatically perform cleaning while moving.

On the contrary, when the control portion 190 recognizes that the first terminal 194 is connected to the second terminal 258, the control portion 190 may control the first motor 113 and the second motor 123 to maintain a stationary state.

In this state, when the cleaning start command is input through the user interface 104, the control portion 190 may not turn on the first motor 113 and the second motor 123 and may turn on the suction motor 164 and the brush motor 132. In this state, it is possible to perform cleaning using the cleaning unit 10. However, the cleaning unit 10 may be manually moved by an external force transferred from the stick unit 20.

Alternatively, the cleaning unit 10 may further include an additional sensing portion for sensing connection between the first terminal 194 and the second terminal 258. In this case, according to sensing information of the sensing portion, the control portion 190 may control the operations of the first motor 113 and the second motor 123. The sensing portion may be a micro switch, a hall sensor, a magnetic sensor, or an optical sensor but is not limited thereto.

The first battery 192 may be charged while the cleaning unit 10 is being docked on a charging device (not shown).

Also, the second battery 240 of the stick unit 20 may receive power supplied from the charging device through the cleaning unit 10 while the stick unit 20 is being connected to the cleaning unit 10.

Alternatively, an additional charging device is connected to the stick unit 20 to allow the second battery 240 of the stick unit 20 to be charged independently from the first battery 192.

Meanwhile, when cleaning is performed while the stick unit 20 is being connected to the cleaning unit 10, due to the suspension structures of the respective transport devices 110 and 120, the cleaning unit 10 is moved while the first wheel 111 and the second wheel 121 are in contact with the floor surface. Here, the cleaning unit 10 may not smoothly move or a force for moving the cleaning unit 10 increases due to a frictional force between the respective wheels 111 and 121 and the floor surface.

Accordingly, the cleaning unit 10 may further include a lifting device to allow the first wheel 111 and the second wheel 121 to be spaced apart from the floor surface while the stick unit 20 is connected to the cleaning unit 10.

Hereinafter, the lifting device will be described.

FIGS. 6 to 10 illustrate a state in which the transport devices 110 and 120 are lifted by the lifting device according the first embodiment.

Referring to FIGS. 6 to 10, the lifting device according to the embodiment may include the connecting member 180 to which the stick unit 20 is connected and a moving portion 170 which may receive a rotating force of the connecting member 180 to move and may lift the respective transport devices 110 and 120.

Throughout the specification, the first transport device 110 and the second transport device 120 may be lifted by the lifting device. Hereinafter, it will be described that the first transport device 110 is lifted by the lifting device.

The connecting member 180 may be rotatably connected to the main body 100. The main body 100 may include a supporter 109 for supporting the connecting member 180.

For example, the supporter 109 may include a shaft 109*a* for rotation of the connecting member 180.

The connecting member 180 may include a supporter coupling portion 181 with which the supporter 109 is coupled. Also, the supporter coupling portion 181 may include a shaft coupling portion 182 with which the shaft 109*a* is to be coupled.

Alternatively, the connecting member 180 may include a shaft and the supporter 109 may include a shaft coupling portion with which the shaft is coupled.

The connecting member 180 may include a contact portion 183 for allowing the moving portion 170 to move during a rotation process. The contact portion 183 is not limited but may extend from the supporter coupling portion 181.

Also, the contact portion 183 may include a protrusion 184 connected to the moving portion 170.

The moving portion 170 may be slidably included in the main body 100. For example, the main body 100 may include a guide rib 179 to guide sliding of the moving portion 170.

The moving portion 170 may include guide slots 174 and 176 in which the protrusion 184 is accommodated. The protrusion 184 may move along the guide slots 174 and 176 during the rotation process.

The guide slots 174 and 176 may include a first slot 174 and a second slot 176. The first slot 174 may have an arc shape to allow the protrusion 184 to move along the first slot 174 during the rotation process of the connecting member 180.

The second slot 176 may extend downward from a bottom end of the first slot 174. For example, the second slot 176 may vertically extend and may have a linear shape.

The moving portion 170 may further include a lifting portion 172 to lift the first transport device 110 while the moving portion 170 is sliding.

The first power transfer device 115 may include an extending pin 118 which extends from the housing 115*a*. Also, the lifting portion 172 may lift the extending pin 118.

The lifting portion 172 may include a guide surface 173 which slants or is rounded to allow the extending pin 118 to be easily seated on the lifting portion 172.

Here, to allow the extending pin 118 to be lifted by the lifting portion 172, a height of a top surface of the lifting portion 172 may be higher than a lowest height of the extending pin 118 while the first wheel 111 is being in contact with the floor surface.

Hereinafter, an operation of the lifting device in accordance with the rotation of the stick unit when the stick unit is connected to the cleaning unit will be described.

Figure 11:
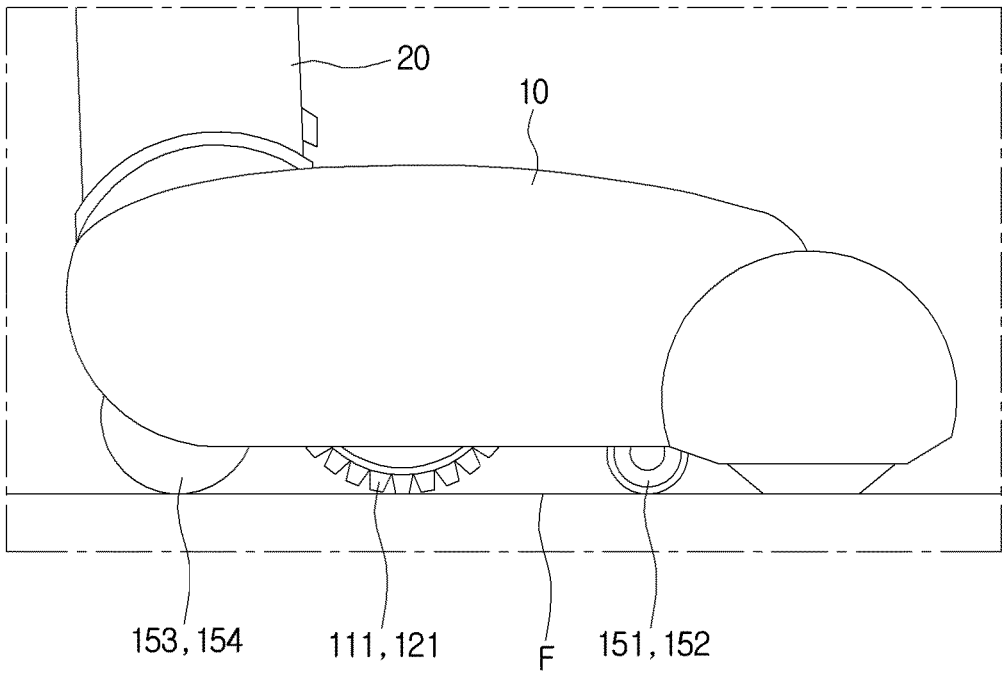
FIG. 11 is a side view of the cleaning apparatus illustrating a state in which wheels are in contact with a floor surface according to the first embodiment.
Figure 12:
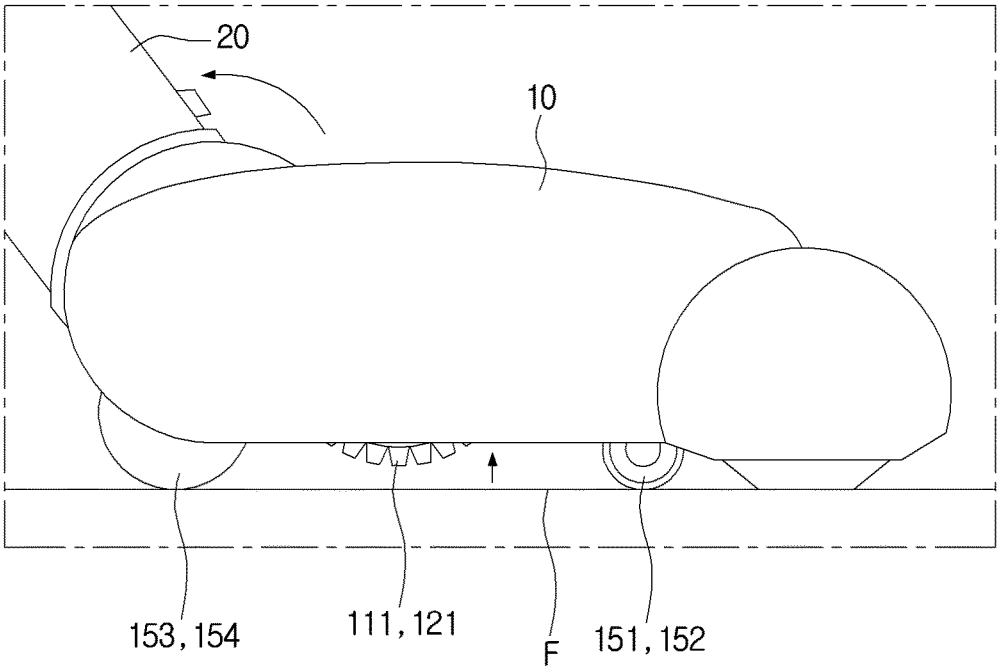
FIG. 12 is a side view of the cleaning apparatus illustrating a state in which the wheels are spaced apart from the floor surface according to the first embodiment.

FIG. 11 is a side view of the cleaning apparatus 1 illustrating a state in which the wheels are in contact with the floor surface according to the first embodiment. FIG. 12 is a side view of the cleaning apparatus 1 illustrating a state in which the wheels are spaced apart from the floor surface according to the first embodiment.

Referring to FIGS. 6 and 11, when the stick unit 20 is connected to the cleaning unit 10, the stick unit 20 may be disposed approximately perpendicular to the cleaning unit 10.

In this case, when the cleaning unit 10 is stored while the stick unit 20 is connected to the cleaning unit 10, interference between the stick unit 20 and objects around the cleaning unit 10 may be minimized.

When the stick unit 20 stands straight to the cleaning unit 10, the wheels 111 and 121 maintain being in contact with a floor surface F due to the suspension structures of the respective transport devices 110 and 120.

Also, when the stick unit 20 stands straight to the cleaning unit 10, the protrusion 184 of the connecting member 180 may be located at a bottom end of the second slot 176 of the moving portion 170.

Also, when the stick unit 20 stands straight to the cleaning unit 10, the lifting portion 172 of the moving portion 170 may be spaced apart from the extending pin 118.

Figure 7:
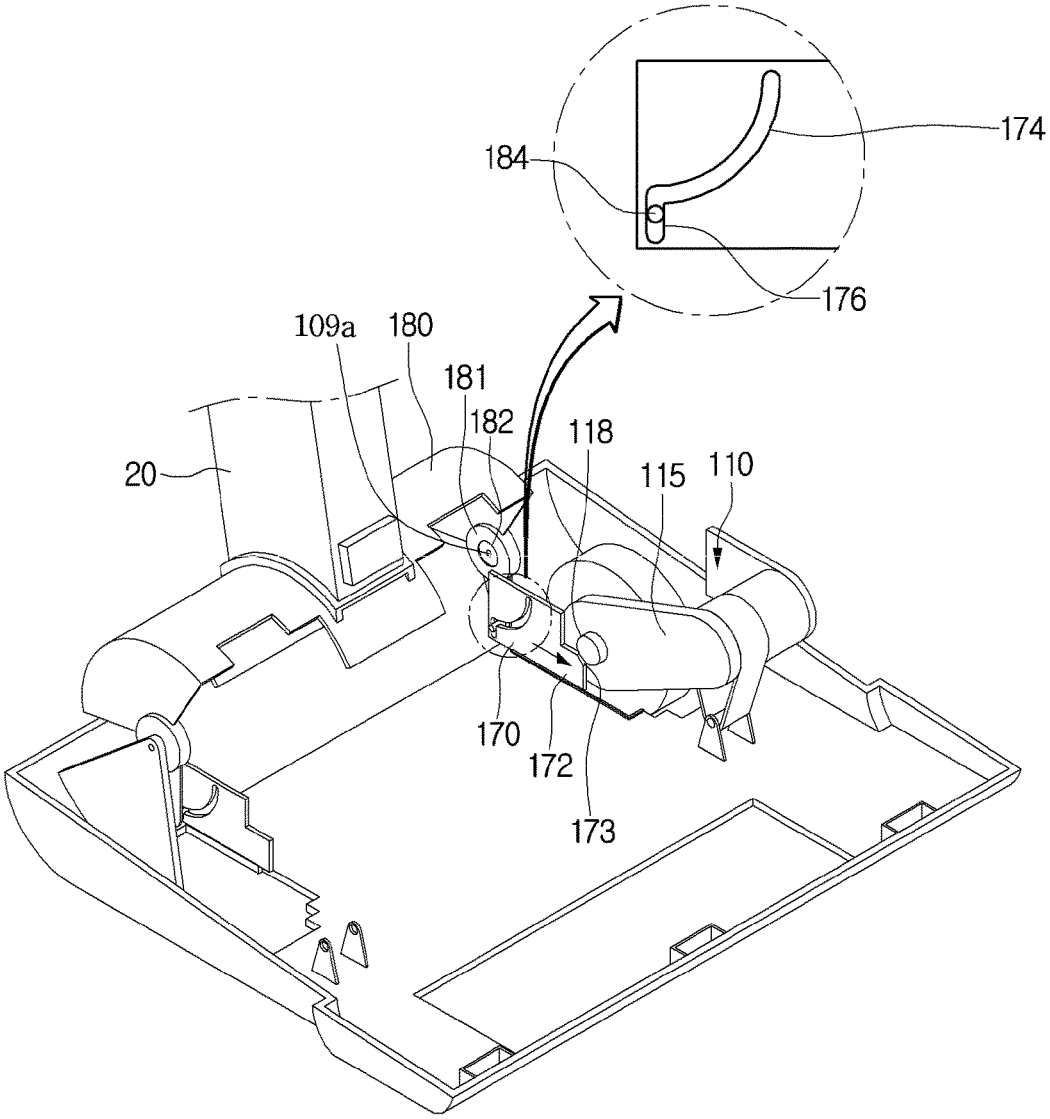

Next, referring to FIG. 7, when the stick unit 20 rotates in one direction, for example, counterclockwise in FIG. 7 at a first angle, the connecting member 180 connected to the stick unit 20 rotates on the shaft 109*a* at the first angle. Also, when the connecting member 180 rotates at the first angle, it is also necessary for the protrusion 184 to rotate on the shaft 109*a* at the first angle.

When the protrusion 184 rotates, a trace of the protrusion 184 has an arc shape. When the protrusion 184 rotates in the arc shape, a height of the protrusion 184 varies. Throughout the specification, since the stick unit 20 is located above the shaft 109*a* and the protrusion 184 is located below the shaft 109*a*, when the stick unit 20 rotates clockwise, the height of the protrusion 184 increases.

In the embodiment, since the protrusion 184 is located below the second slot 176 of the moving portion 170, to allow the protrusion 184 to rotate on the shaft 109*a*, it is necessary for the protrusion 184 to ascend from the second slot 176. Here, since the second slot 176 has a linear shape, the protrusion 184 moves the moving portion 170 while the protrusion 184 is ascending along the second slot 176.

That is, while the protrusion 184 is ascending along the second slot 176, the moving portion 170 moves closer to the extending pin 118 (toward an upper right side in the drawing).

While the moving portion 170 is moving closer to the extending pin 118, the extending pin 118 may be in contact with the guide surface 173 of the lifting portion 172.

Figure 8:
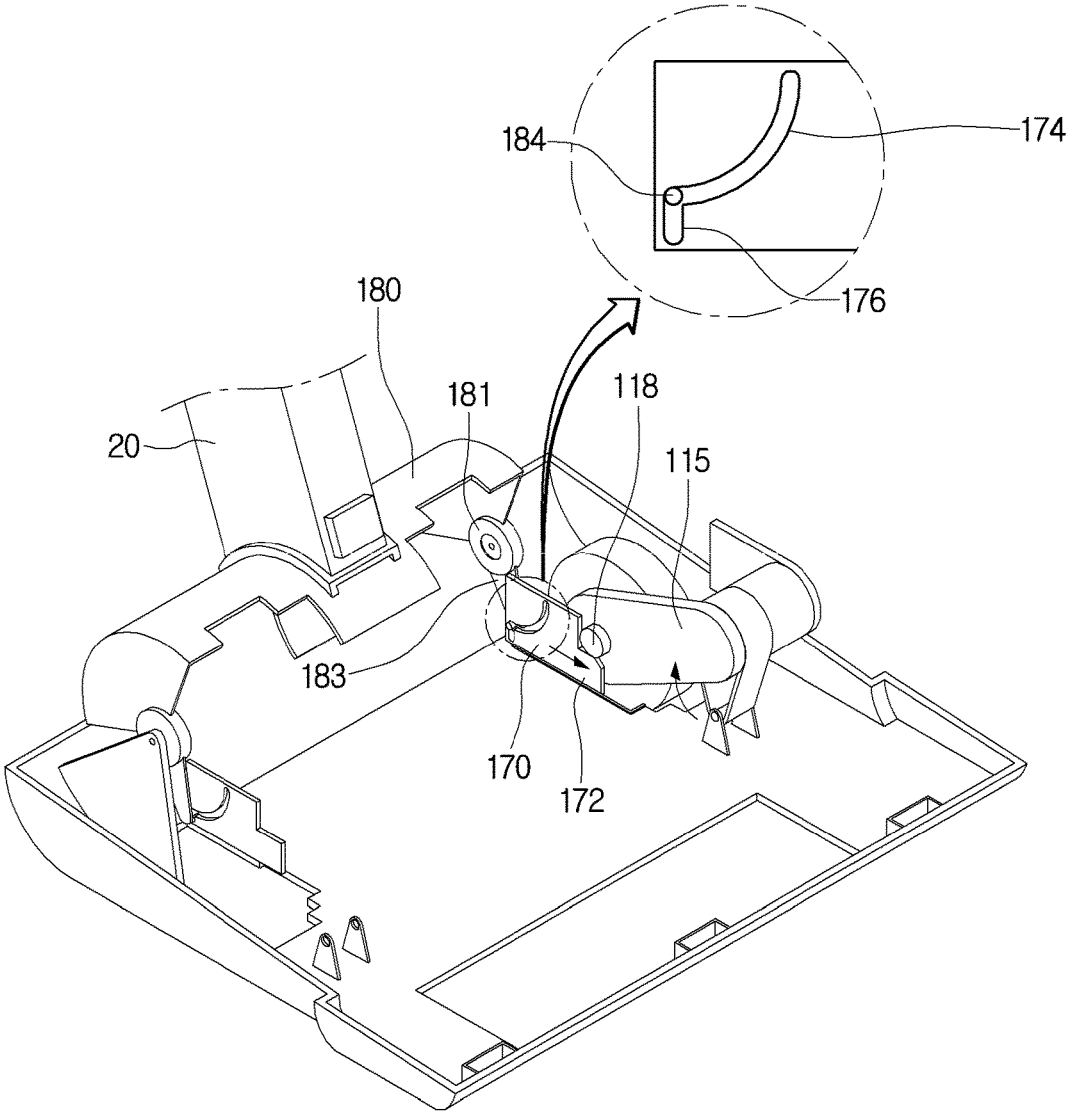

Next, referring to FIGS. 8 and 12, when the stick unit 20 rotates in one direction at a second angle greater than the first angle, while the protrusion 184 is moving to a top end of the second slot 176, that is, a borderline area between the first slot 174 and the second slot 176, the extending pin 118 ascends along the guide surface 173 of the lifting portion 172 and the first transport device 110 rotates on the hinge axis 108*a* clockwise in the drawing. Also, the extending pin 118 is seated on the top surface of the lifting portion 172, and accordingly, the respective wheels 111 and 121 are spaced apart from the floor surface F.

Figure 9:
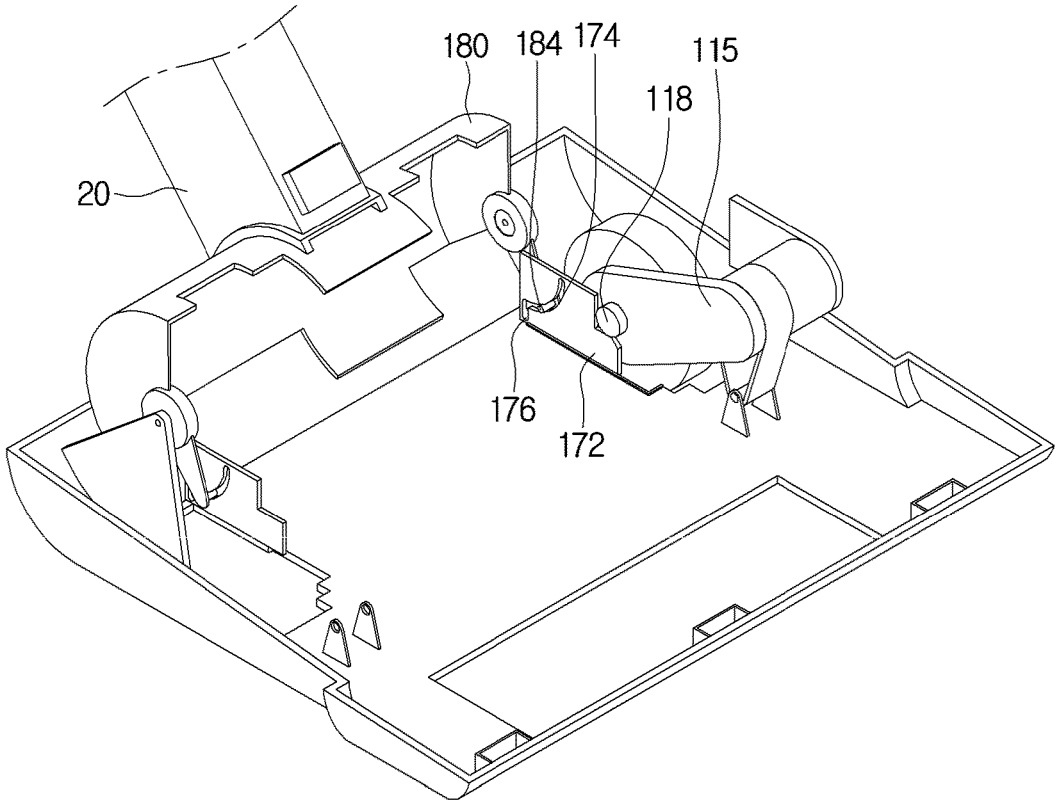
Figure 10:
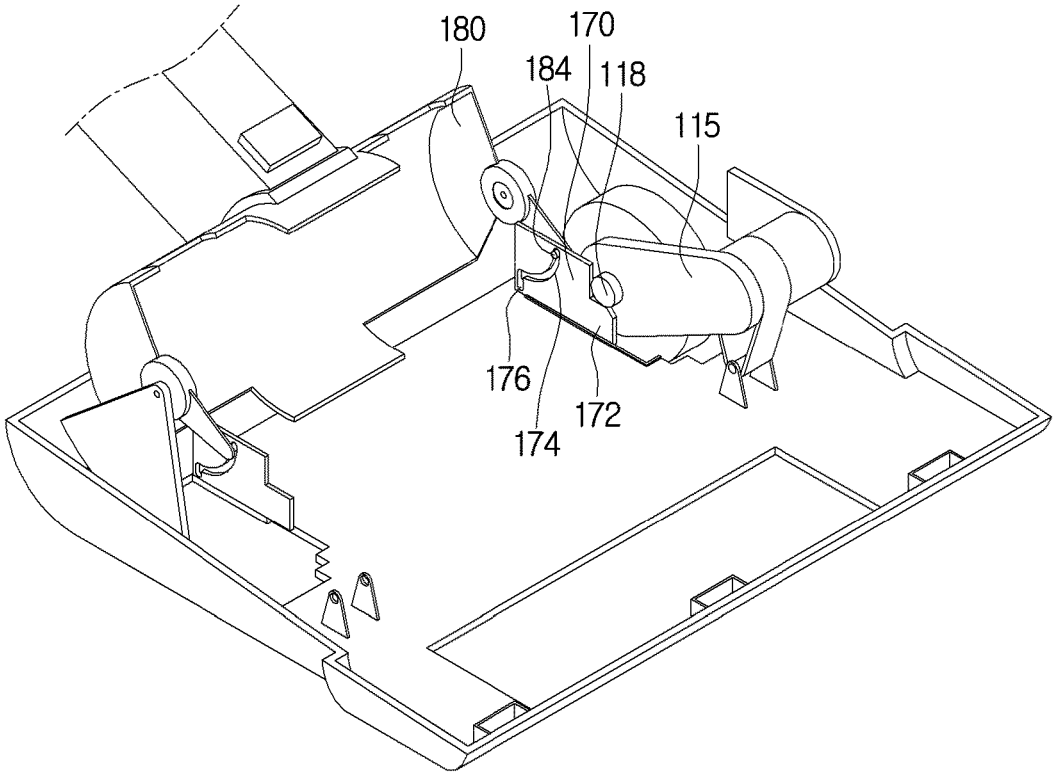

Next, referring to FIGS. 9 and 10, when the extending pin 118 is seated on the top surface of the lifting portion 172 and the stick unit 20 further rotates in one direction at a third angle greater than the second angle, the protrusion 184 is allowed to move along the first slot 174.

Here, a shape of the first slot 174 may be identical to the trace of the protrusion 184.

Accordingly, since a moving force of the protrusion 184 is not transferred to the moving portion 170 while the protrusion 184 is moving along the first slot 174, the moving portion 170 maintains a stationary state and the respective wheels 111 and 121 maintain an ascending state.

Also, the user may freely rotate the stick unit 20 in one direction or another direction within a range of the angle of the first slot 174.

According to the embodiment, when the stick unit 20 is rotated at a certain angle or more in one direction, since the respective wheels 111 and 121 may be spaced apart from the floor surface F by the lifting device, the user may move the cleaning unit 10 using less force while manually moving the cleaning unit 10.

That is, as shown in FIG. 12, when the stick unit 20 is rotated at a certain angle or more, the respective wheels 111 and 121 are spaced apart from the floor surface F by the lifting device and the plurality of auxiliary wheels 151, 152, 153, and 154 are in contact with the floor surface F. Accordingly, when there is no present frictional force between the respective wheels 111 and 121 and the floor surface F, the cleaning unit 10 may be moved by the plurality of auxiliary wheels 151, 152, 153, and 154.

Figure 13:
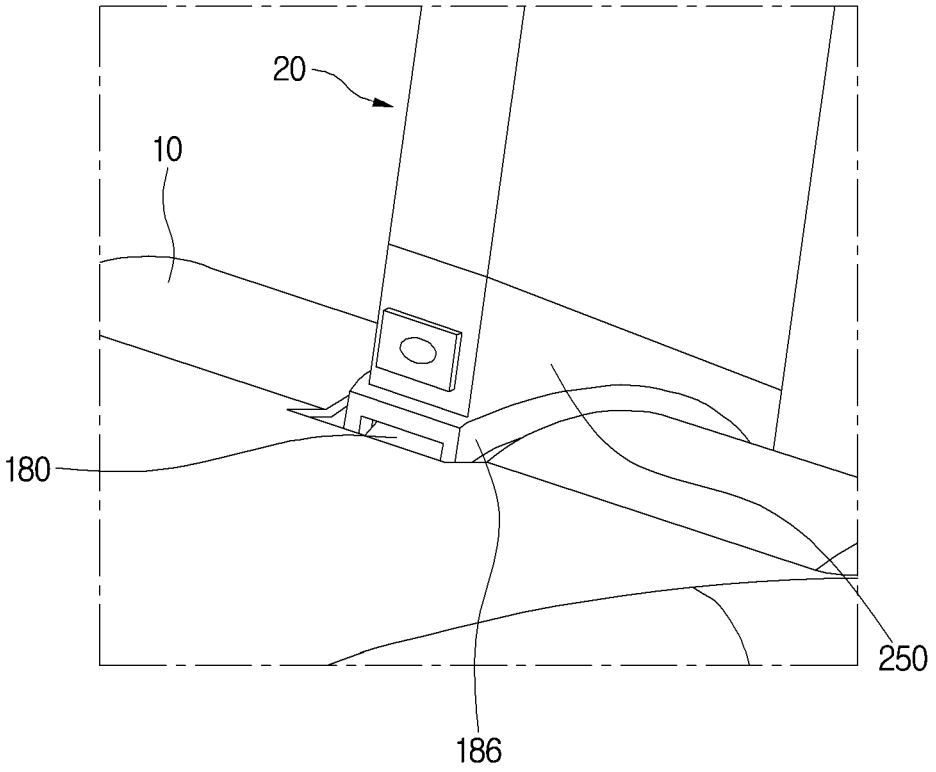
FIG. 13 is a view illustrating a state in which a stick unit is coupled with the cleaning unit according to the first embodiment.
Figure 14:
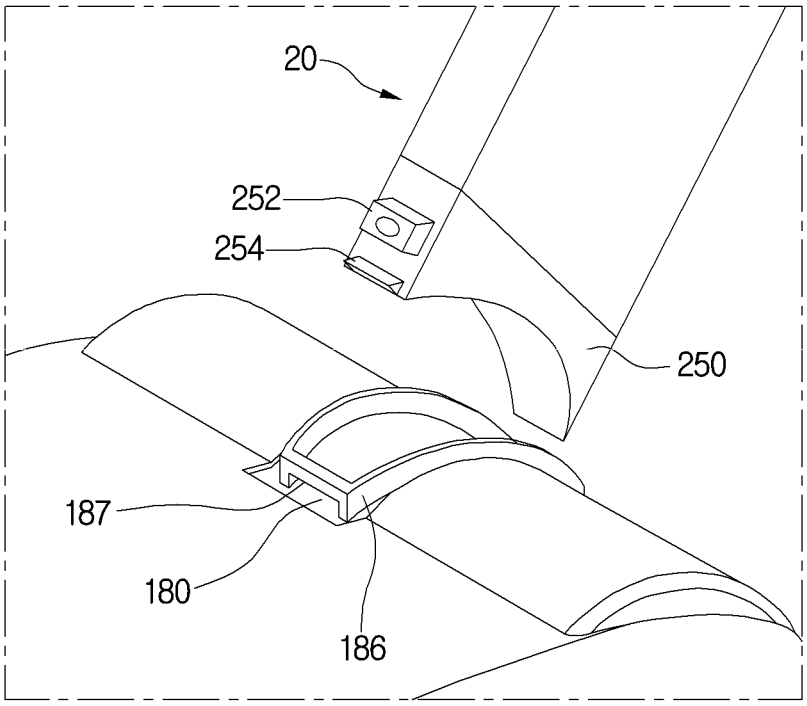
FIG. 14 is a view illustrating a state in which the stick unit is separated from the cleaning unit according to the first embodiment.

FIG. 13 is a view illustrating a state in which the stick unit 20 is coupled with the cleaning unit 10 according to the first embodiment. FIG. 14 is a view illustrating a state in which the stick unit 20 is separated from the cleaning unit 10 according to the first embodiment.

Referring to FIGS. 13 and 14, the cleaning unit 10 may include a first coupling portion 186 for allowing the stick unit 20 to be coupled therewith.

The stick unit 20 may include a second coupling portion 250 for being coupled with the first coupling portion 186.

For example, the first coupling portion 186 may be provided at the connecting member 180.

The second coupling portion 250 may include a coupling button 252. The coupling button 252 may be supported by an elastic member (not shown). The coupling button 252 may include a hook 254.

Also, the first coupling portion 186 may include a hook coupling portion 187 with which the hook 254 is coupled.

As shown in FIG. 13, when the coupling button 252 is pushed while the first coupling portion 186 is being coupled with the second coupling portion 250, the hook 254 is separated from the hook coupling portion 187. In this state, when the stick unit 20 is pulled upward, the stick unit 20 may be separated from the cleaning unit 10.

Figure 15:
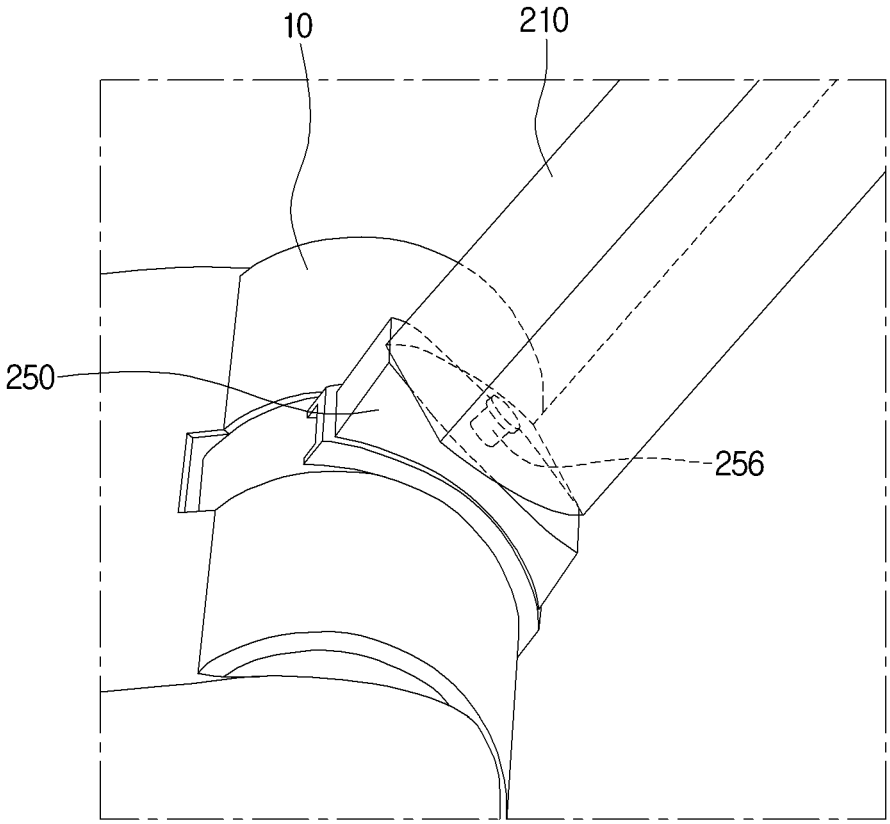
FIG. 15 is a view illustrating a state in which one part of the stick unit pivots from another part of the stick unit according to the first embodiment.

FIG. 15 is a view illustrating a state in which one part of the stick unit 20 pivots from another part of the stick unit 20 according to the first embodiment.

Referring to FIG. 15, the one part of the stick unit 20 may pivot from the other part of the stick unit 20. That is, the stick unit 20 may pivot not only on an axis which extends in a horizontal direction but also on an axis which extends in a vertical direction or a direction which intersects with the horizontal direction.

For example, the stick bodies 210 and 220 may pivot on a hinge axis 256 at the second coupling portion 250.

Accordingly, according to the embodiment, since the stick unit 20 is pivotable not only on the axis which extends in the horizontal direction but also on the axis which extends in the vertical direction or the direction which intersects with the horizontal direction, the operability of the stick unit 20 increases when the user manually moves the cleaning unit 10.

Figure 16:
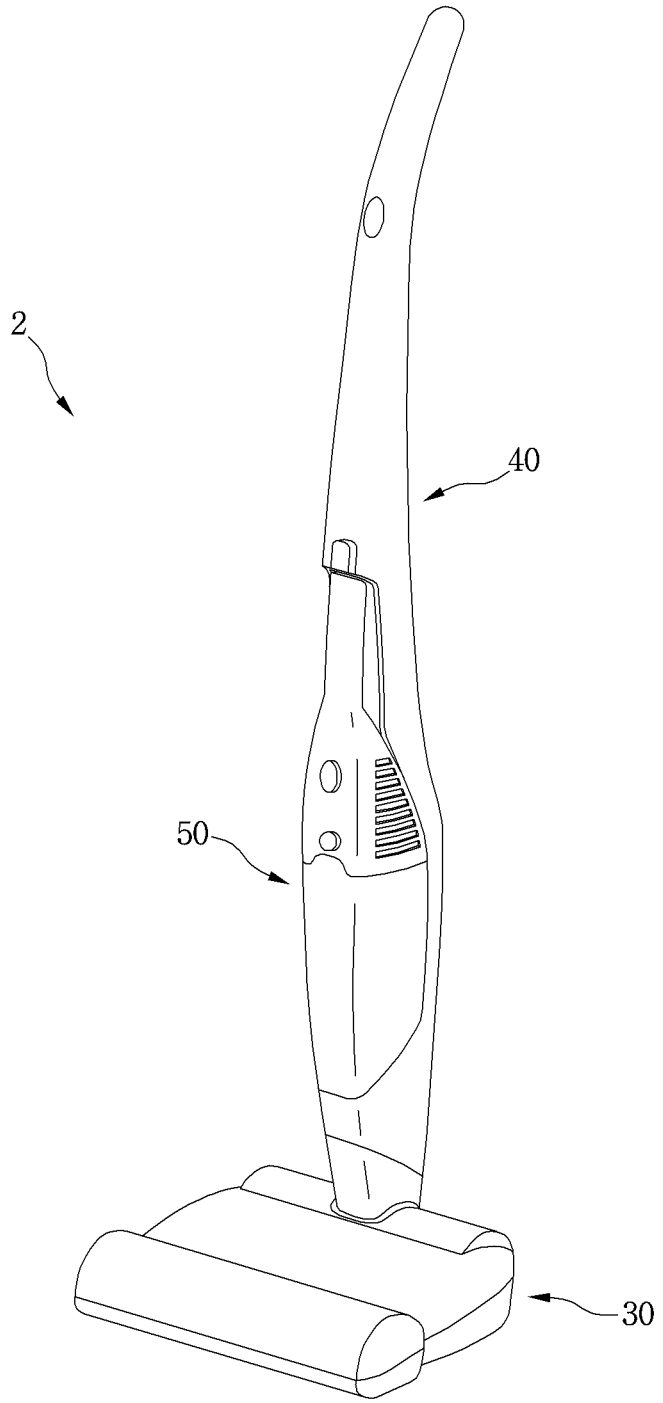
FIG. 16 is a perspective view of a cleaning apparatus according to a second embodiment.
Figure 17:
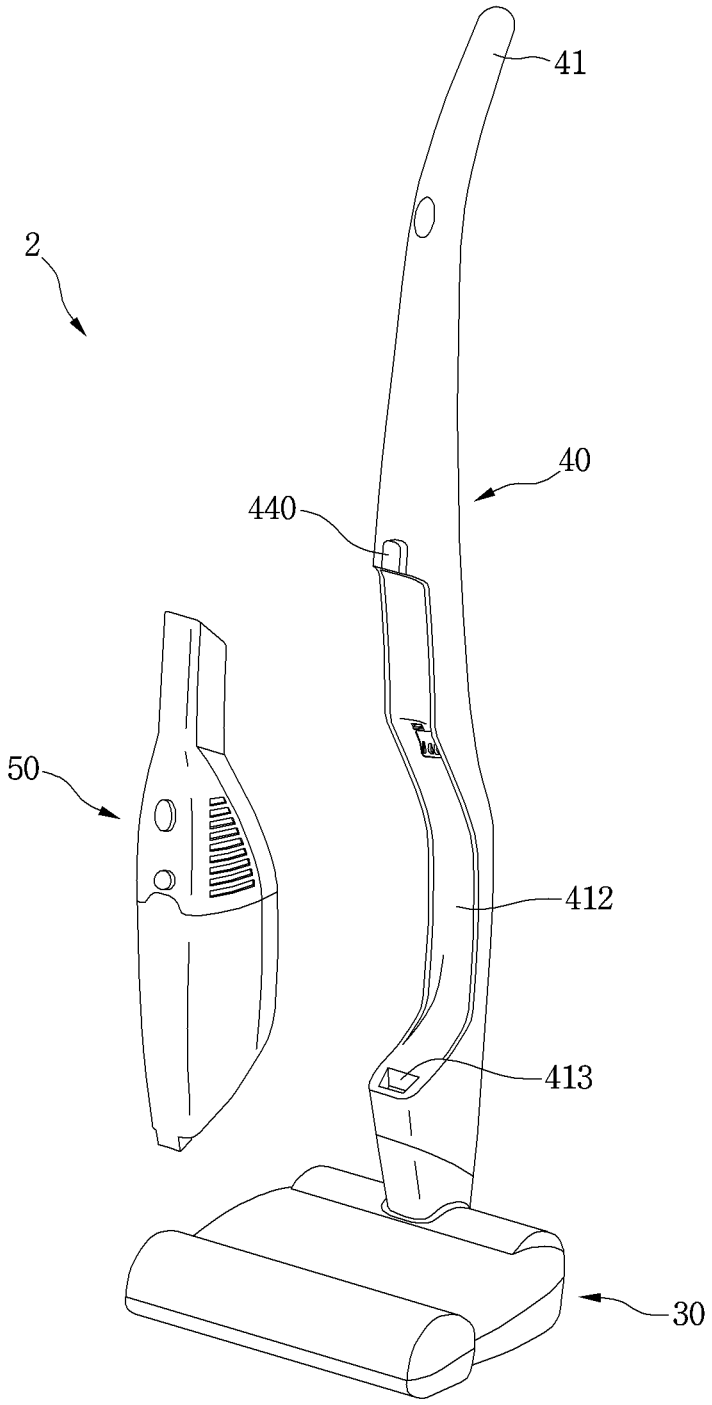
FIG. 17 is a perspective view illustrating a state in which a plurality of cleaning units are separated from a stick unit according to the second embodiment.

FIG. 16 is a perspective view of a cleaning apparatus 2 according to a second embodiment. FIG. 17 is a perspective view illustrating a state in which a plurality of cleaning units are separated from a stick unit 40 according to the second embodiment.

Referring to FIGS. 16 and 17, the cleaning apparatus 2 according to the embodiment may include a first cleaning unit 30 which may automatically move, the stick unit 40 which may be separably coupled with the first cleaning unit 30, and a second cleaning unit 50 which may be separably coupled with the stick unit 40.

Although not limited, the first cleaning unit 30 may clean a floor surface and the second cleaning unit 50 may clean not only the floor surface but also various areas in addition to the floor surface. Accordingly, the first cleaning unit 30 may be referred to as a floor surface cleaning unit and the second cleaning unit 50 may be referred to as a hand type cleaning unit.

In the second embodiment, the first cleaning unit 30 may correspond to the cleaning unit 10 in the first embodiment and the stick unit 40 may correspond to the stick unit 20 in the first embodiment.

Accordingly, since all descriptions of the cleaning unit 10 in the first embodiment may be identically applied to the first cleaning unit 30 in the second embodiment, hereinafter, only particular features of the second embodiment will be described.

The stick unit 40 may include a handle 41 to be gripped by a user. The handle 41 may be a part of a top of the stick unit 40.

The stick unit 40 may further include a mounting portion 412 on which the second cleaning unit 50 is to be mounted.

The mounting portion 412 may include an accommodating portion 413 for accommodating a part of the second cleaning unit 50.

The stick unit 40 may be coupled with the second cleaning unit 50 and may include a button 440 able to be pressurized by the user to release a coupling state with the second cleaning unit 50.

Alternatively, the button 440 may be a button operated to release coupling between the stick unit 40 and the second cleaning unit 50 and an operation force of the button 440 may be transferred to a coupling member (not shown) to release coupling between the coupling member and the second cleaning unit 50.

In the embodiment, all components which receive power of a battery to operate such as a suction force generating device may be referred to as a power consumption unit.

Figure 18:
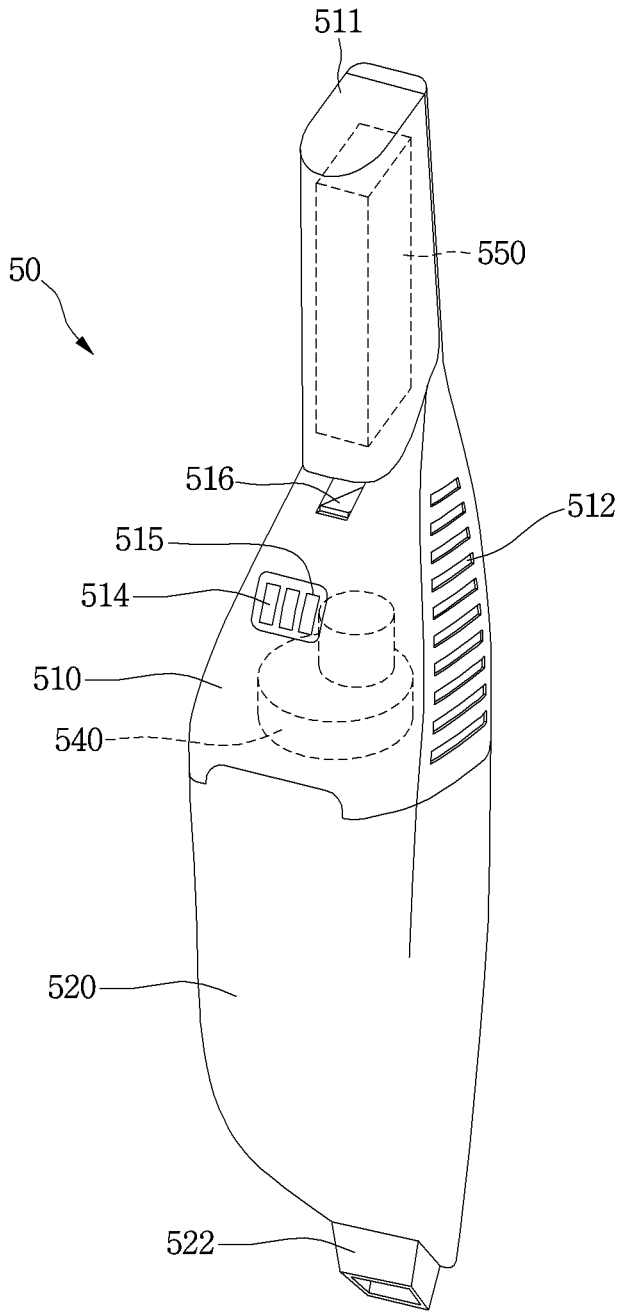
FIG. 18 is a perspective view of a second cleaning unit according to the second embodiment.
Figure 19:
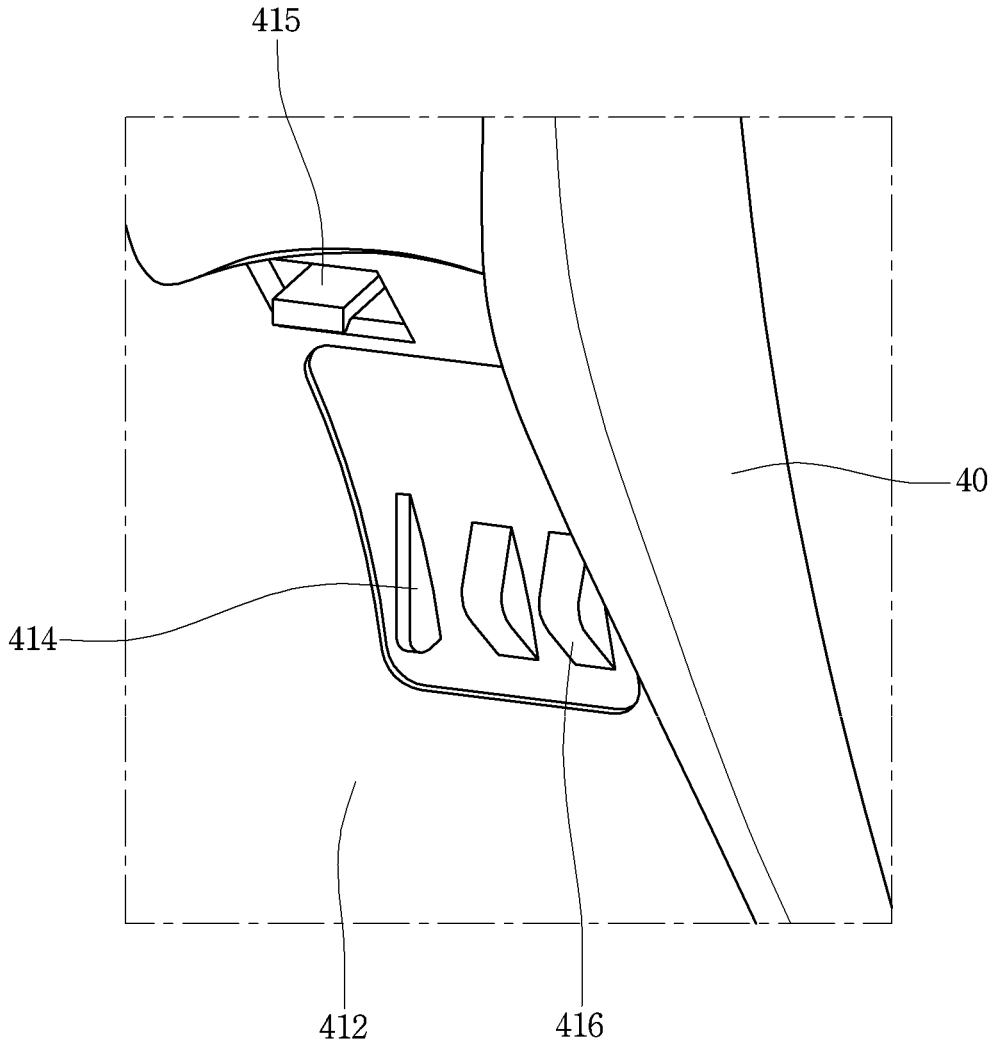
FIG. 19 is a view of a mounting portion of the stick unit according to the second embodiment.

FIG. 18 is a perspective view of the second cleaning unit 50 according to the second embodiment. FIG. 19 is a view of the mounting portion 412 of the stick unit 40 according to the second embodiment.

Referring to FIGS. 18 and 19, the second cleaning unit 50 may include a motor frame 510 which accommodates a suction motor 540 and a dust collecting body 520 connected to the motor frame 510 to store dust.

The dust collecting body 520 may include an air inlet 522 into which air and dust flow, and the motor frame 510 may include an air outlet 512 through which the air separated from the dust is discharged. The air inlet 522, for example, may be accommodated in the accommodating portion 413 of the mounting portion 412. Also, air in the stick unit 40 may flow from the accommodating portion 413 to the air inlet 522.

The motor frame 510 may further include a handle 511 to be gripped by the user.

The stick unit 40 and the second cleaning unit 50 may be electrically connected. For this, the mounting portion 412 of the stick unit 40 may include a first terminal 416 and the second cleaning unit 50 may include a second terminal 514 able to be in contact with the first terminal 416.

Although not limited, the second terminal 514 may be included in the motor frame 510.

To stably maintain a contact state between the first terminal 416 and the second terminal 514, the stick unit 40 may include a protrusion 414 and the motor frame 510 may include an accommodating portion 515 in which the protrusion 414 is accommodated. While the protrusion 414 is accommodated in the accommodating portion 515, the movement of the second cleaning unit 50 may be prevented.

Also, for strong coupling between the stick unit 40 and the second cleaning unit 50, the stick unit 40 may include a hook 415 and the second cleaning unit 50 may include a hook coupling portion 516 on which the hook 415 is held.

The second cleaning unit 50 may further include a battery 550 for supplying power to the suction motor 540.

When the second cleaning unit 50 is mounted on the stick unit 40, the battery 550 may be connected to the battery 192 (refer to FIG. 5) included in the first cleaning unit 30.

Figure 20:
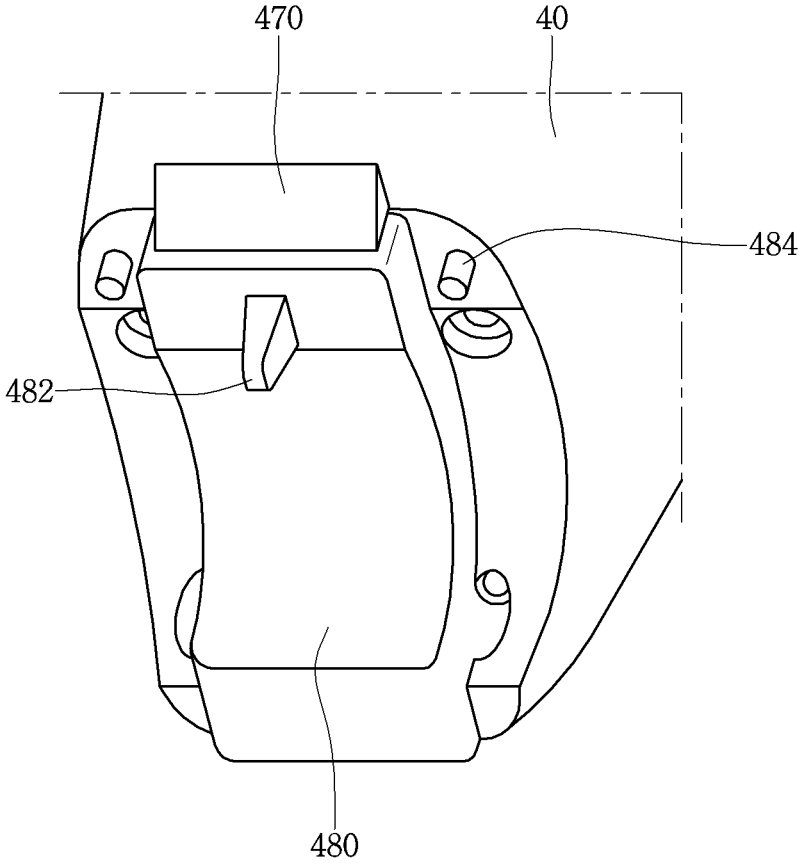
FIG. 20 is a view illustrating a part of the stick unit coupled with a first cleaning unit according to the second embodiment.
Figure 21:
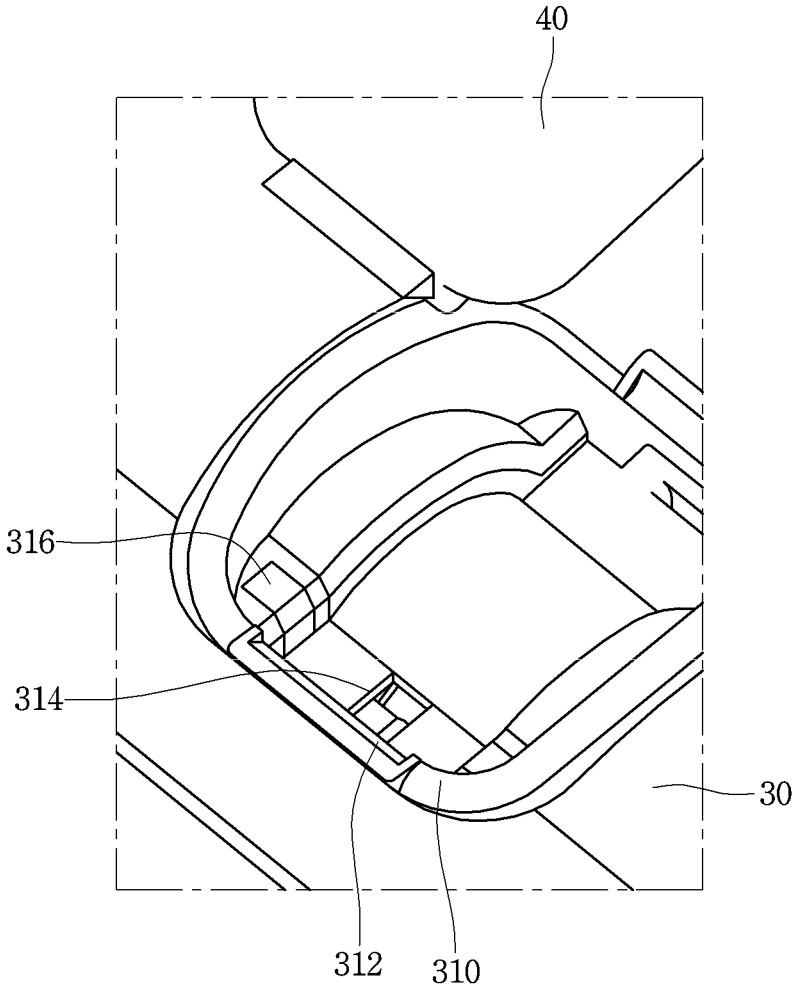
FIG. 21 is a view illustrating a part of the first cleaning unit coupled with the stick unit.

FIG. 20 is a view illustrating a part of the stick unit 40 coupled with the first cleaning unit 30 according to the second embodiment. FIG. 21 is a view illustrating a part of the first cleaning unit 30 coupled with the stick unit 40.

Referring to FIGS. 20 and 21, the stick unit 40 may include a lower body 480 able to be in contact with the first cleaning unit 30.

The first cleaning unit 30 may include a connecting member 310 connectable with the lower body 480. Since the connecting member 310 corresponds to the connecting member 180 in the first embodiment, a detailed description thereof will be omitted.

When the lower body 480 is connected to the connecting member 310, the connecting member 310 may move in response to the movement of the lower body 480. For this, the connecting member 310 may include a first connecting portion 314 and the lower body 480 may include a second connecting portion 482 connected to the first connecting portion 314. For example, one of the first connecting portion 314 and the second connecting portion 482 may be a protrusion and the other may be an accommodating portion which accommodates the protrusion.

The first cleaning unit 30 may include a third terminal 316 for being electrically connected to the stick unit 40, and the stick unit 40 may include a fourth terminal 484 able to be in contact with the third terminal 316.

Although not limited, the third terminal 316 may be disposed at the connecting member 310 and the fourth terminal 484 may be disposed at the lower body 480.

Accordingly, according to the embodiment, even when the stick unit 40 moves while being connected to the first cleaning unit 30, a contact state between the third terminal 316 and the fourth terminal 484 may be maintained.

For coupling between the stick unit 40 and the first cleaning unit 30, the first cleaning unit 30 may include a first coupling portion 312 and the stick unit 40 may include a second coupling portion 470 for being coupled with the first coupling portion 312.

Figure 22:
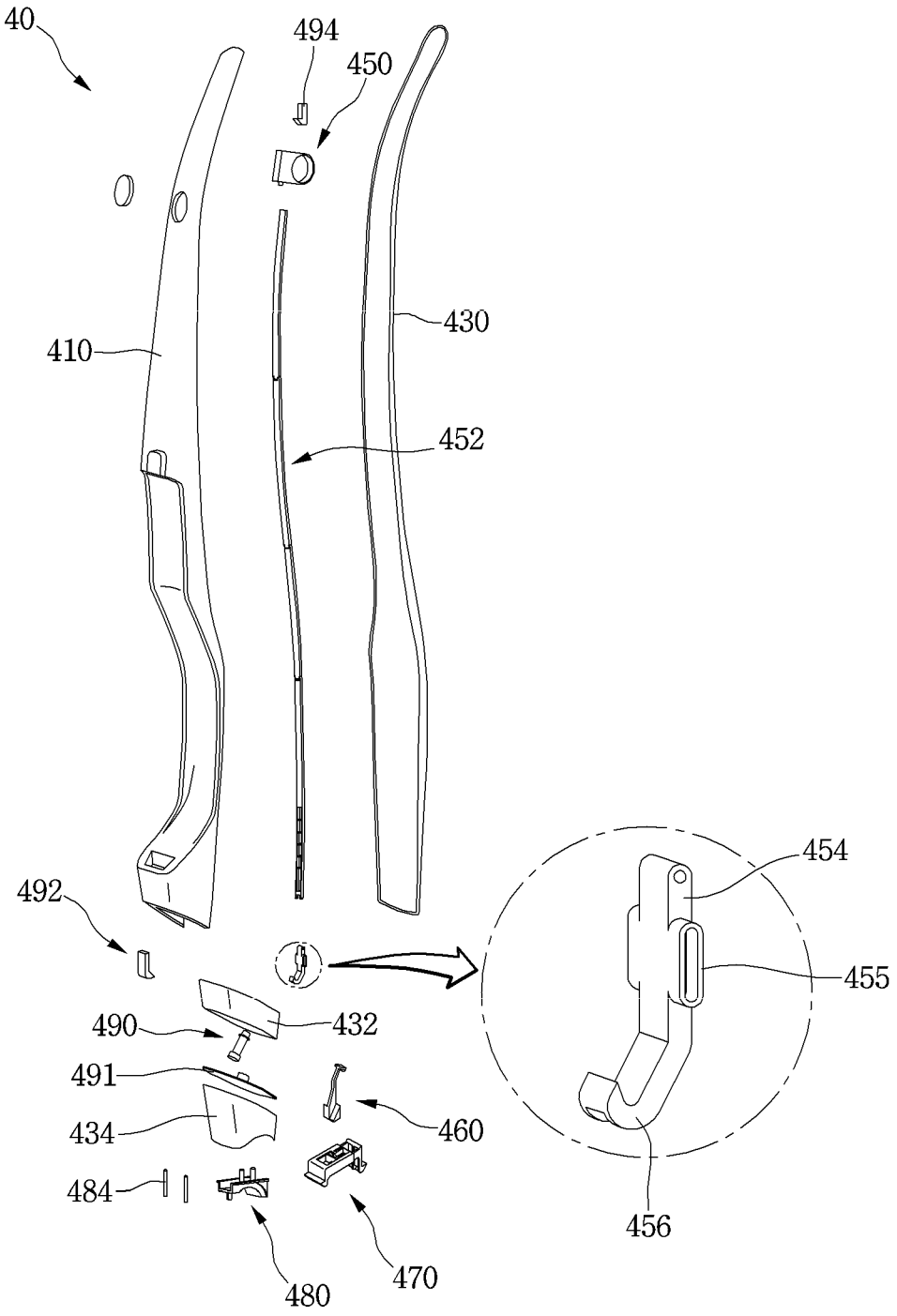
FIG. 22 is an exploded perspective view of the stick unit according to the second embodiment.

To allow the stick unit 40 to move while being coupled with the first cleaning unit 30, the first coupling portion 312 is disposed at the connecting member 310 and the second coupling portion 470 may be seated on the lower body 480 (refer to FIG. 22).

FIG. 22 is an exploded perspective view of the stick unit 40 according to the second embodiment.

Referring to FIGS. 16 to 22, the stick unit 40 according to the second embodiment may include a main body.

The main body may include a first body 410 which includes the mounting portion 412 and a second body 430 coupled with the first body 410. For example, the first body 410 may be a front body and the second body 430 may be a rear body.

The stick unit 40 may further include a third body 432 coupled with a bottom of the main body and a fourth body 434, which may be referred to as a connecting body, coupled with a bottom of the third body 432.

The fourth body 434 may be pivotably connected to the third body 432. For example, the fourth body 434 and the third body 432 may be relatively-pivotably connected to by a shaft 490.

The third body 432 may be integrally connected to the stick bodies 410 and 430 as a single body or may be separately formed and coupled with the stick bodies 410 and 430.

The lower body 480 may be coupled with a bottom of the fourth body 434.

The stick unit 40 may further include an operation portion 450 operable to separate the stick unit 40 from the first cleaning unit 30 and a power transfer portion for transferring an operation force of the operation portion 450 to the second coupling portion 470.

Although not limited, the operation portion 450 may penetrate the second body 430 and protrude outward from the stick unit 40.

The user may operate the operation portion 450 while the stick unit 40 is being coupled with the first cleaning unit 30. Here, to allow the user to easily operate the operation portion 450, the operation portion 450 may be disposed at the handle 41 or may be disposed in a position adjacent to the handle 41. Accordingly, for example, the user may operate the operation portion 450 while holding the handle 41.

That is, the user may operate the operation portion 450 and move the stick unit 40 separated from the first cleaning unit 30 while holding the handle 41 using one hand.

Since the operation portion 450 may be disposed at the handle 41 or disposed in a position adjacent to the handle 41 and the second coupling portion 470 is located below the stick unit 40, at least one component of the power transfer portion may transfer power in a vertical direction.

The power transfer portion may include one or more links 452 which transfer the operation force of the operation portion 450 in the vertical direction.

Although not limited, a plurality of links 452 are arranged in the vertical direction while being mutually pivotably connected by hinges.

The power transfer portion may further include a first connector 454 connected to the one or more links 452.

When the power transfer portion includes the plurality of links 452, the operation portion 450 may be connected to an uppermost link of the plurality of links 452 and the first connector 454 may be connected to a lowermost link of the plurality of links 452.

The lowermost link may be pivotably connected with the first connector 454 by a hinge.

The first connector 454 may include a guide slot 455 to guide a vertical movement of the first connector 454. The guide slot 455, not shown in the drawings, may accommodate a guide protrusion included in the second body 430.

The power transfer portion may further include a second connector 460 to selectively receive the operation force of the operation portion 450 from the first connector 454.

The second connector 460 may be connected to the second coupling portion 470. The second connector 460 may be connected with the first connector 454 when the stick unit 40 is located in a reference position in which the stick unit 40 does not horizontally pivot.

That is, when the third body 432 and the fourth body 434 do not relatively pivot, the second connector 460 may be connected with the first connector 454.

The first connector 454 may include a first connecting hook 456 to be selectively held by the second connector 460.

The stick unit 40 may further include a pivoting limiting portion 492 to limit the horizontal pivoting of the stick unit 40 while the stick unit 40 is being connected to the first cleaning unit 30 and standing straight and a limiting guide 491 which operates with the pivoting limiting portion 492.

The stick unit 40 may further include an operation limiting portion 494 which limits the operation of the operation portion 450 when the stick unit 40 pivots downward at a certain angle from a state in which the stick unit 40 is connected to the first cleaning unit 30.

Figure 23:
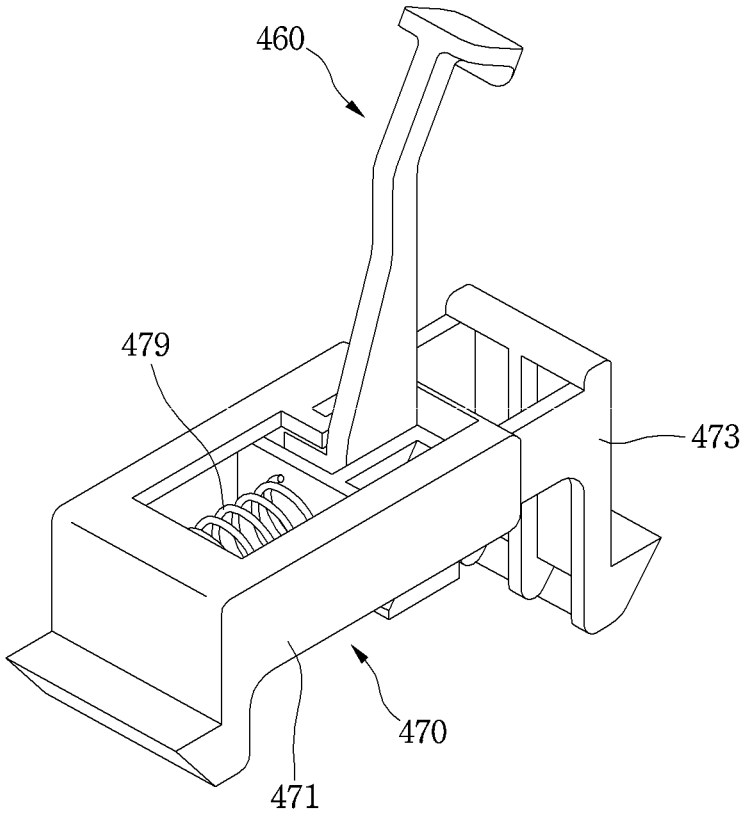
FIG. 23 is a view illustrating a state in which a second connector is connected with a second coupling portion according to the second embodiment.
Figure 24:
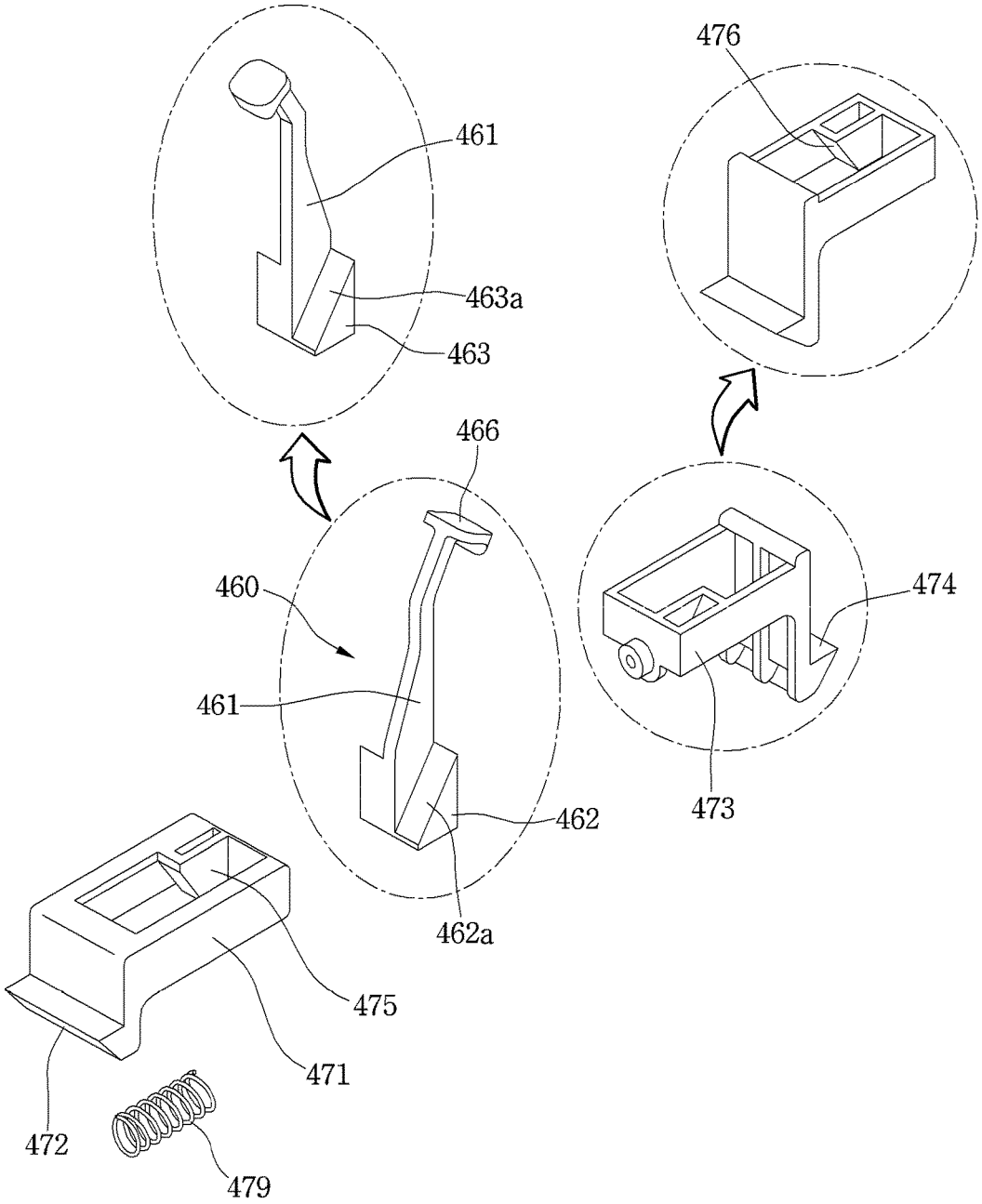
FIG. 24 is a view illustrating a state in which the second connector is separated from the second coupling portion according to the second embodiment.

FIG. 23 is a view illustrating a state in which the second connector 460 is connected with the second coupling portion 470 according to the second embodiment. FIG. 24 is a view illustrating a state in which the second connector 460 is separated from the second coupling portion 470 according to the second embodiment.

Referring to FIGS. 23 and 24, the second coupling portion 470 may be disposed inside the fourth body 434.

The second coupling portion 470 may include a first coupling body 471 and a second coupling body 473 movably connected to the first coupling body 471. The first coupling body 471 may include a first coupling hook 472, and the second coupling body 473 may include a second coupling hook 474.

The first coupling body 471 may further include a first cam guide 475, and the second coupling body 473 may include a second cam guide 476.

When the second coupling body 473 and the first coupling body 471 are connected, the second connector 460 may be located between the first cam guide 475 and the second cam guide 476.

The second connector 460 may include a connecting body 461. A second connecting hook 466 able to be selectively held by the first connecting hook 456 may be provided at one side of the connecting body 461.

A first cam 462 and a second cam 463 may be provided at the other side of the connecting body 461. The first cam 462 and the second cam 463 include slanting surfaces 462*a* and 463*a*, respectively.

The first slanting surface 462*a* of the first cam 462 may be in contact with the second cam guide 476, and the second slanting surface 463*a*of the second cam 463 may be in contact with the first cam guide 475.

When the second connector 460 receives the operation force of the operation portion 450 from the first connector 454, the second connector 460 moves upward. Due to the upward movement of the second connector 460, the first coupling body 471 and the second coupling body 473 may move in a horizontal direction. For example, the respective coupling hooks 472 and 474 of the respective coupling bodies 471 and 473 may move to be closer to each other.

The first coupling body 471 and the second coupling body 473 may be elastically supported by an elastic member 479. The elastic member 479 provides an elastic force for the respective coupling bodies 471 and 473 to maintain a state in which the second coupling portion 470 is coupled with the first coupling portion 312 of the first cleaning unit 30.

Although not limited, to allow the respective coupling hooks 472 and 474 of the respective coupling bodies 471 and 473 to move to be farther from each other, the elastic member 479 may provide the elastic force for the respective coupling bodies 471 and 473.

Hereinafter, the operation of the power transfer portion will be described.

Figure 25:
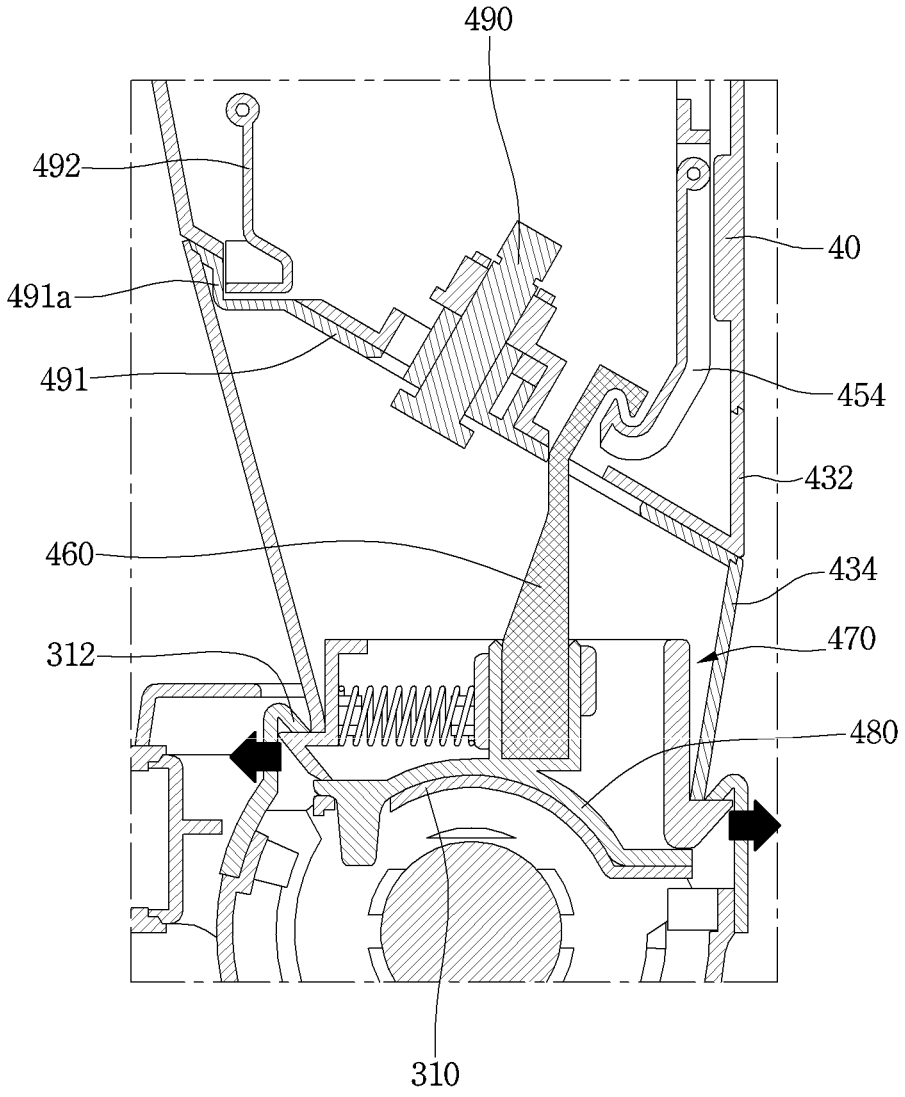
FIG. 25 is a view illustrating a state in which the stick unit is coupled with the first cleaning unit according to the second embodiment.
Figure 26:
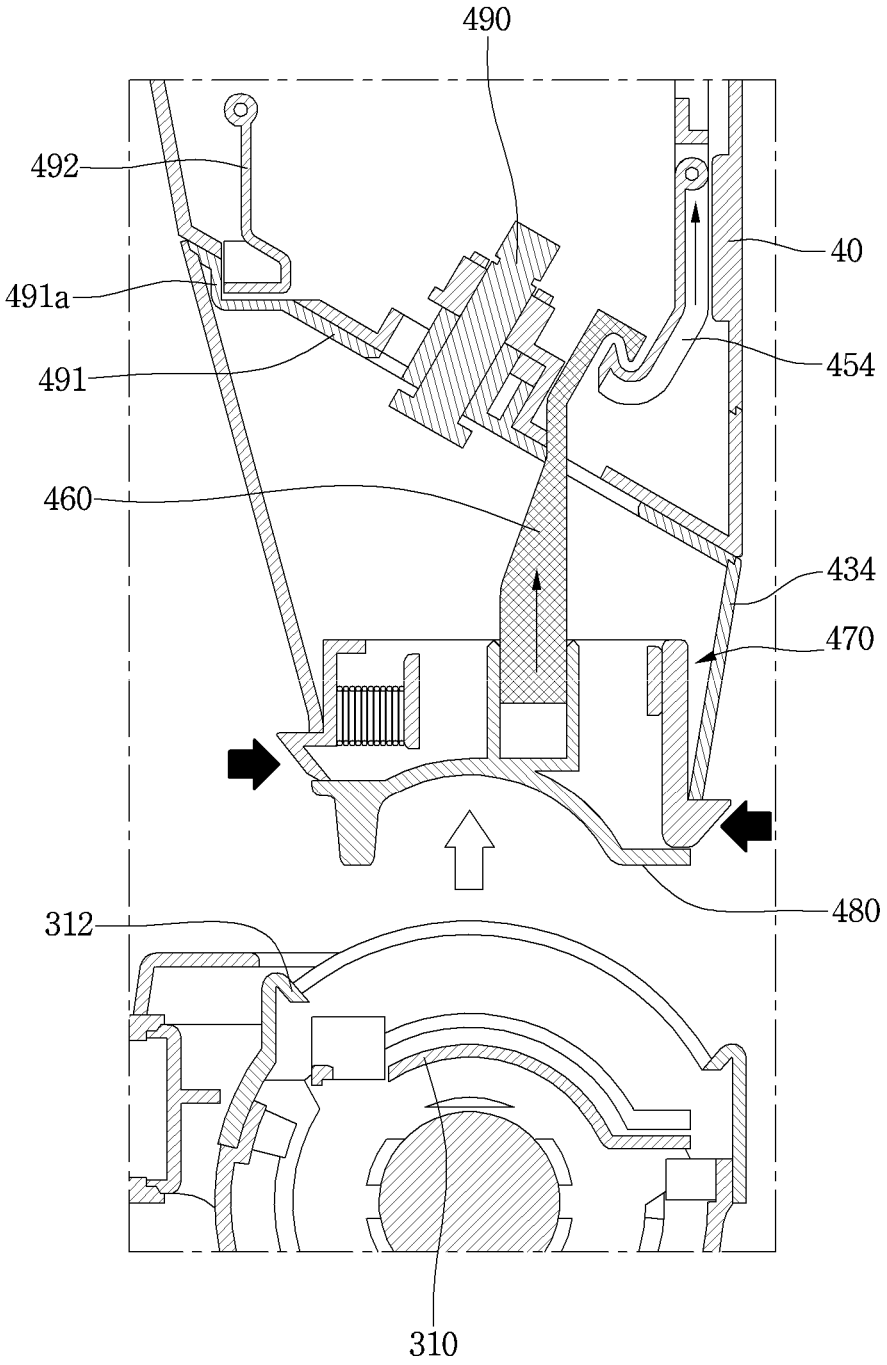
FIG. 26 is a view illustrating a state in which the stick unit is released from the first cleaning unit according to the second embodiment.
Figure 27:
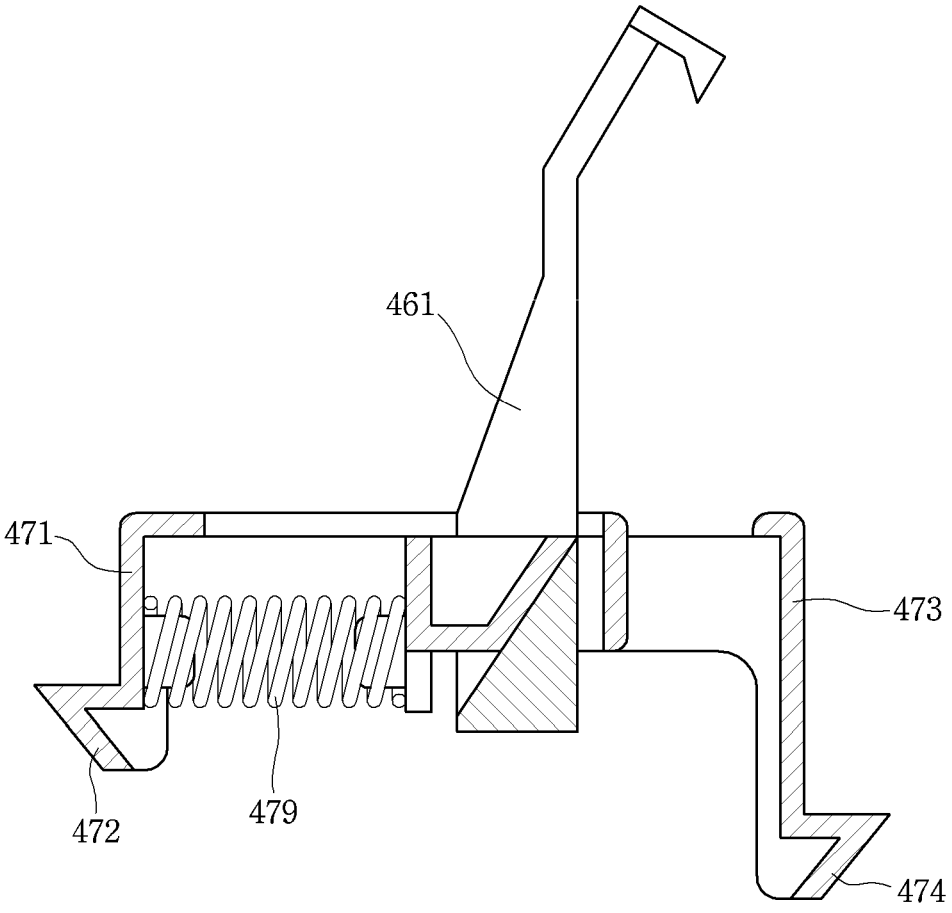
FIGS. 27 and 28 are schematic diagrams illustrating an operation of the second coupling portion according to a vertical movement of the second connector.
Figure 28:
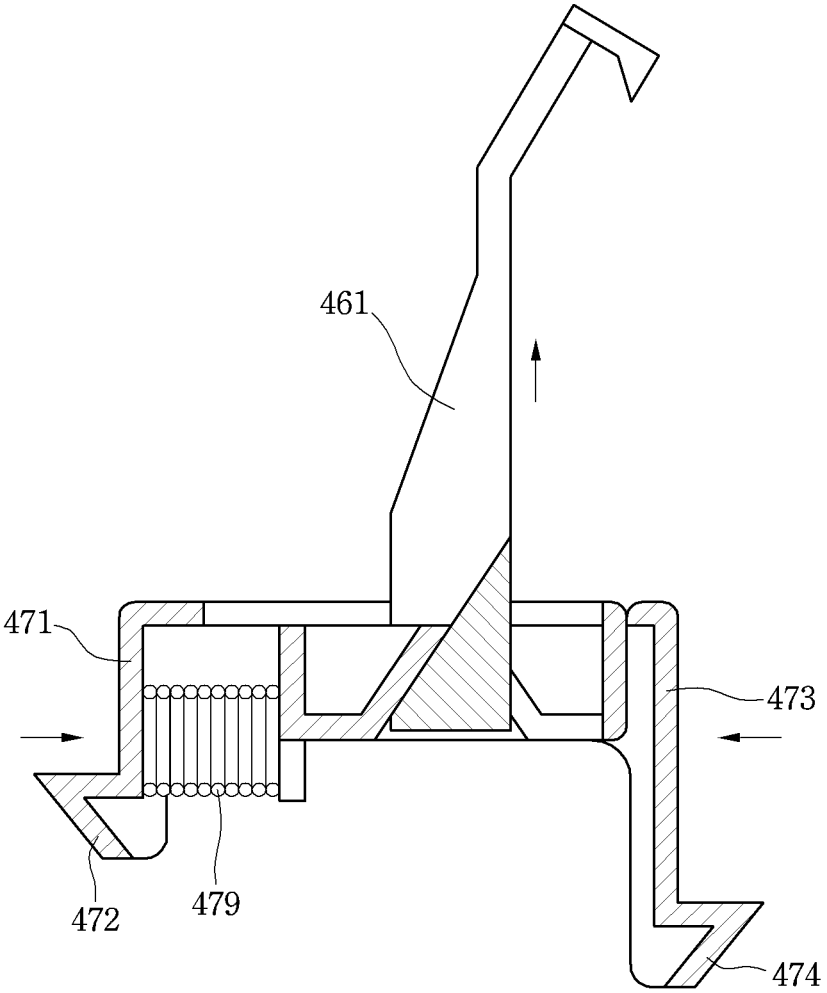

FIG. 25 is a view illustrating a state in which the stick unit 40 is coupled with the first cleaning unit 30 according to the second embodiment. FIG. 26 is a view illustrating a state in which the stick unit 40 is released from the first cleaning unit 30 according to the second embodiment. FIGS. 27 and 28 are schematic diagrams illustrating an operation of the second coupling portion 470 according to a vertical movement of the second connector 460.

Referring to FIGS. 23 to 28, when the second coupling portion 470 is coupled with the first coupling portion 312, the stick unit 40 is coupled with the first cleaning unit 30.

Since the elastic member 479 elastically supports the respective coupling bodies 471 and 473 in directions to allow the respective coupling hooks 472 and 474 to become farther from each other, a coupling state between the second coupling portion 470 and the first coupling portion 312 may be stably maintained.

When the stick unit 40 is allowed to stand straight while being coupled with the first cleaning unit 30, the pivoting limiting portion 492 is accommodated in an accommodating groove 491*a* provided in the limiting guide 491.

The limiting guide 491 may be coupled with the third body 432 or the fourth body 434. Also, the shaft 490 may penetrate the limiting guide 491.

When the pivoting limiting portion 492 is accommodated in the accommodating groove 491*a*, a part of the stick unit 40, for example, the main body may be prevented from pivoting on the shaft 490.

In the embodiment, when the stick unit 40 is coupled with the first cleaning unit 30 and when the stick unit 40 stands straight, the horizontal pivoting of the stick unit 40 is limited to prevent the stick unit 40 from being separated from the first cleaning unit 30.

Since the second connector 460 and the first connector 454 are not in alignment with each other when the part of the stick unit 40 pivots in a horizontal direction, the operation force of the operation portion 450 may not be transferred to the second coupling portion 470. In this case, despite the operation of the operation portion 450, the stick unit 40 is not separated from the first cleaning unit 30.

Accordingly, in the embodiment, when the stick unit 40 is coupled with the first cleaning unit 30 and when the stick unit 40 stands straight, the second connector 460 and the first connector 454 are to be in alignment with each other, thereby separating the stick unit 40 from the first cleaning unit 30 through the operation of the operation portion 450.

Meanwhile, as shown in FIG. 26, to separate the stick unit 40 from the first cleaning unit 30, the user may operate the operation portion 450. Although not limited, the user may pull the operation portion 450.

Then, the operation force of the operation portion 450 may be transferred to the second coupling portion 470 through the power transfer portion.

The operation force of the operation portion 450 may be transferred to the first connector 454 through the one or more links 452. Since the first connector 454 and the second connector 460 are in alignment with each other when the stick unit 40 stands straight, the second connector 460 may receive the operation force of the operation portion 450 from the first connector 454.

Then, the second connector 460 may move upward. When the second connector 460 moves upward, the first cam 462 and the second cam 463 move upward. When the respective cams 462 and 463 move upward, the respective coupling bodies 471 and 473 are allowed to move in the horizontal direction due to interactions between the slanting surfaces 462*a* and 463*a* of the respective cams 462 and 463 and the cam guides 475 and 476 of the respective coupling bodies 471 and 473. As described above, the respective coupling bodies 471 and 473 move in directions to allow the respective coupling hooks 472 and 474 to become closer to each other.

When the respective coupling bodies 471 and 473 move in the directions to allow the respective coupling hooks 472 and 474 to become closer to each other, coupling between the second coupling portion 470 and the first coupling portion 312 is released and the stick unit 40 becomes separable from the first cleaning unit 30. In this state, when the user lifts the stick unit 40 upward, the stick unit 40 may be separated from the first cleaning unit 30.

Figure 29:
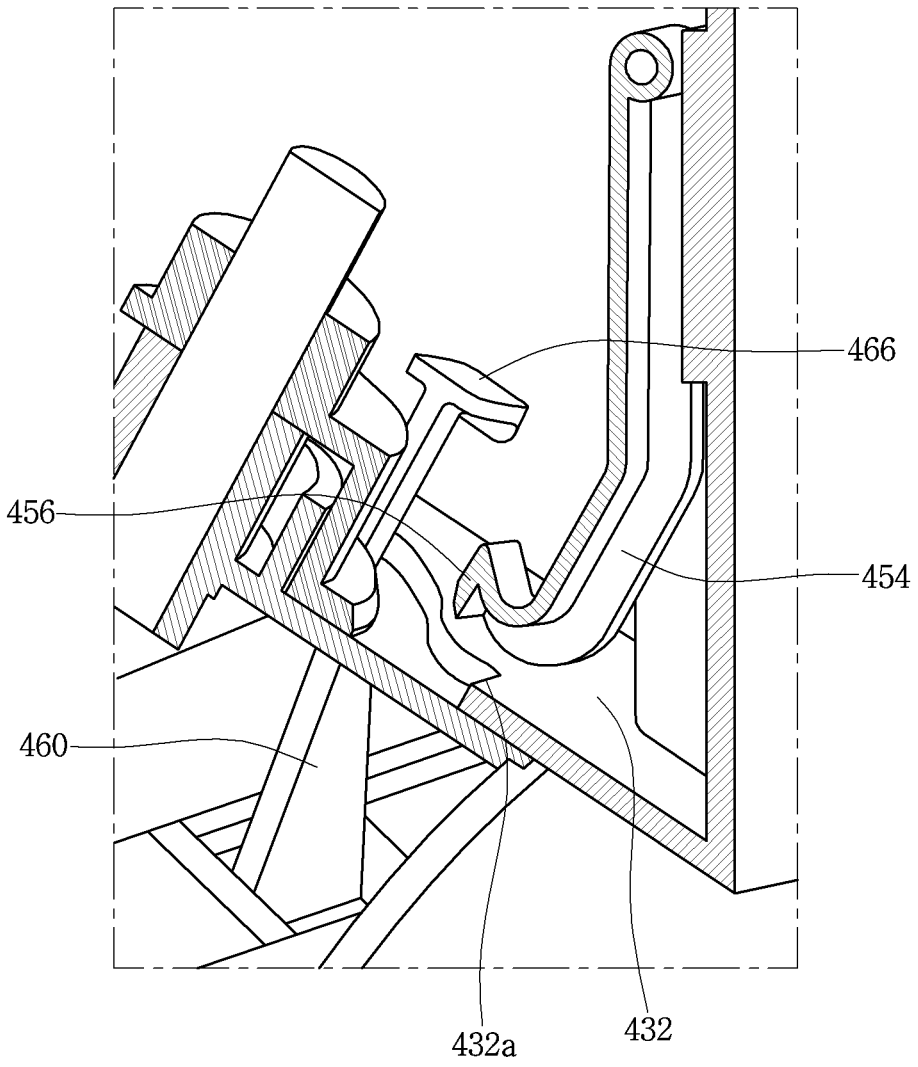
FIG. 29 is a view illustrating positions of a first connector and the second connector in a state in which the stick unit is horizontally pivoted according to the second embodiment.

FIG. 29 is a view illustrating positions of the first connector 454 and the second connector 460 in a state in which the stick unit 40 is horizontally pivoted according to the second embodiment.

Referring to FIG. 29, the second connector 460 may penetrate the third body 432. Accordingly, the second connecting hook 466 of the second connector 460 may be located inside the third body 432. At least a part of the first connector 454 may be located inside the third body 432.

To allow a part of the stick unit 40 to be horizontally pivoted based on the shaft 490, the third body 432 may include a guide hole 432*a* to prevent the interference of the second connector 460.

Accordingly, the part of the stick unit 40 may be horizontally pivoted based on the shaft 490 by the guide hole 432*a*. In this state, the first connecting hook 456 of the first connector 454 and the second connecting hook 466 of the second connector 460 are misaligned. Accordingly, in this state, the operation force of the operation portion 450 is not transferred to the second connector 460.

Generally, when the part of the stick unit 40 is horizontally pivoted, it may be a state of cleaning a floor surface using the stick unit 40 and the first cleaning unit 30 while the stick unit 40 is connected to the first cleaning unit 30.

In this case, since it is necessary to prevent the stick unit 40 from being separated from the first cleaning unit 30 during a cleaning process, the first connecting hook 456 of the first connector 454 and the second connecting hook 466 of the second connector 460 may be misaligned.

Figure 30:
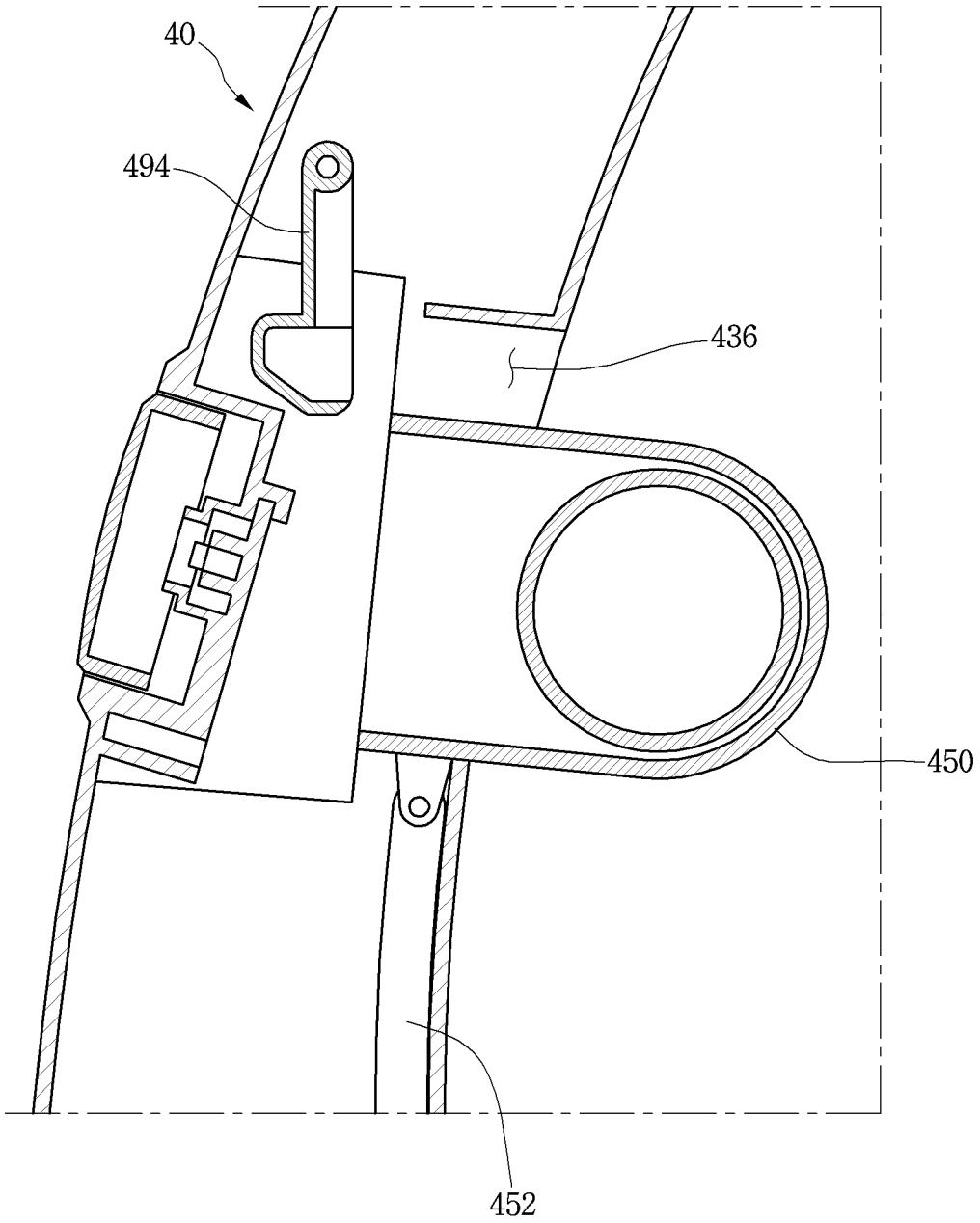
FIG. 30 is a view illustrating positions of an operation portion and an operation limiting portion in a state in which the stick unit stands straight according to the second embodiment.
Figure 31:
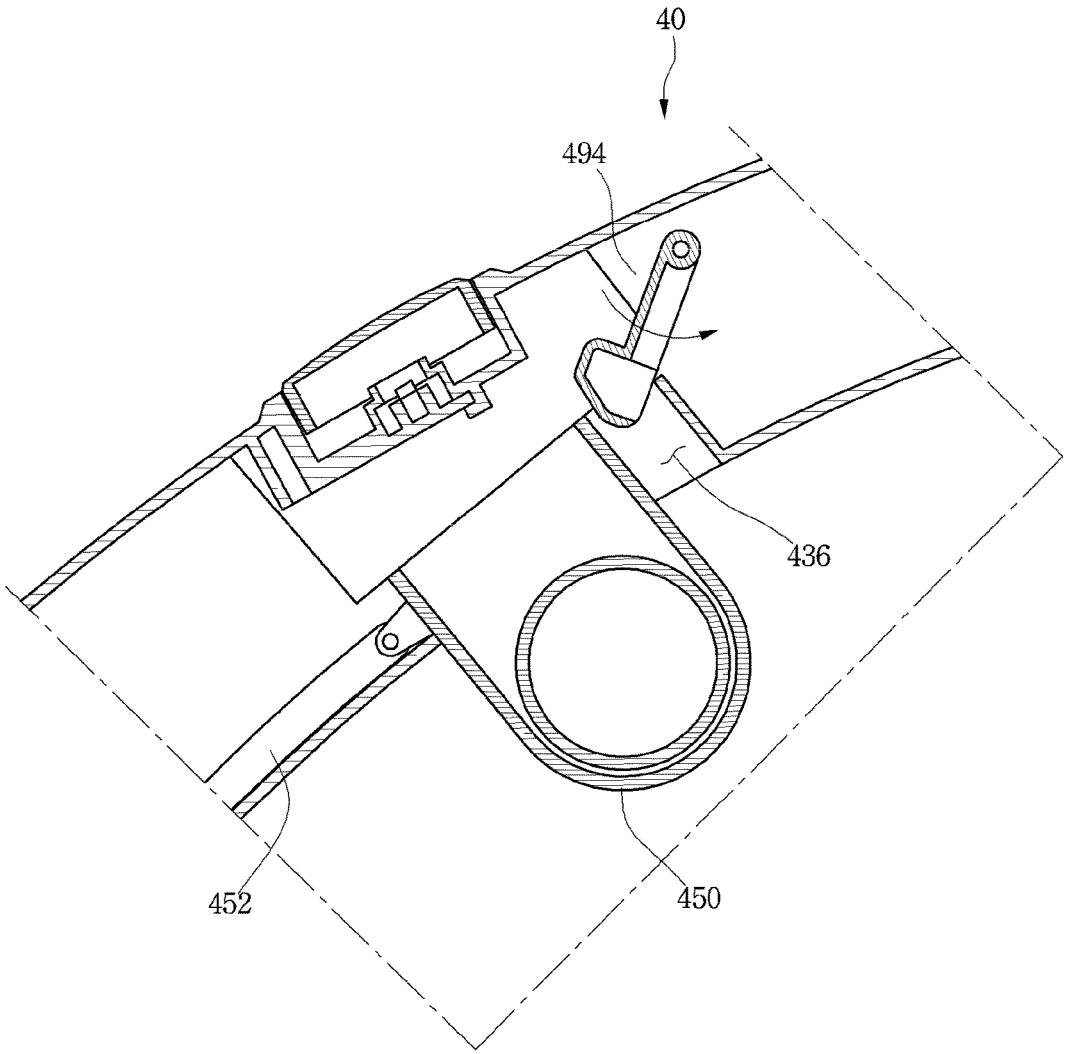
FIG. 31 is a view illustrating positions of the operation portion and the operation limiting portion in a state in which the stick unit pivots at a certain angle according to the second embodiment.

FIG. 30 is a view illustrating positions of the operation portion 450 and the operation limiting portion 494 in a state in which the stick unit 40 stands straight according to the second embodiment. FIG. 31 is a view illustrating positions of the operation portion 450 and the operation limiting portion 494 in a state in which the stick unit 40 pivots at a certain angle according to the second embodiment.

Referring to FIGS. 30 and 31, the operation limiting portion 494 may be pivotably provided inside the stick unit 40. Here, the operation limiting portion 494 may be pivotably disposed in an idle state in the stick unit.

The stick unit 40 may include a through hole 436 to allow the operation portion 450 to pass therethrough. The operation portion 450 may penetrate the through hole 436, may protrude outward from the stick unit 40, and may move inside the through hole 436. That is, the through hole 436 provides a path for movement of the operation portion 450.

The operation limiting portion 494 may be disposed in a position adjacent to the operation portion 450. Also, the operation limiting portion 494 may be selectively located in the through hole 436 depending on a tilt angle of the stick unit 40.

When the stick unit 40 stands straight as shown in FIG. 30, the operation limiting portion 494 is disposed out of the through hole 436.

Accordingly, in this state, the operation portion 450 is operable and the operation portion 450 is movable in the through hole 436 without interference with the operation limiting portion 494.

On the contrary, when the stick unit 40 pivots at the certain angle or more as shown in FIG. 31, the operation limiting portion 494 is allowed to be located in the through hole 436. That is, the operation limiting portion 494 pivots and is allowed to be located in the path of the movement of the operation portion 450.

In the state described above, even when to operate the operation portion 450, since the operation portion 450 is not allowed to move due to interference with the operation limiting portion 494, the operation of the operation portion 450 is limited.

Accordingly, according to the embodiment, the operation of the operation portion 450 is prevented in a process of cleaning using the stick unit 40 and the first cleaning unit 30, thereby preventing the stick unit 40 from being separated from the first cleaning unit 30.

Figure 32:
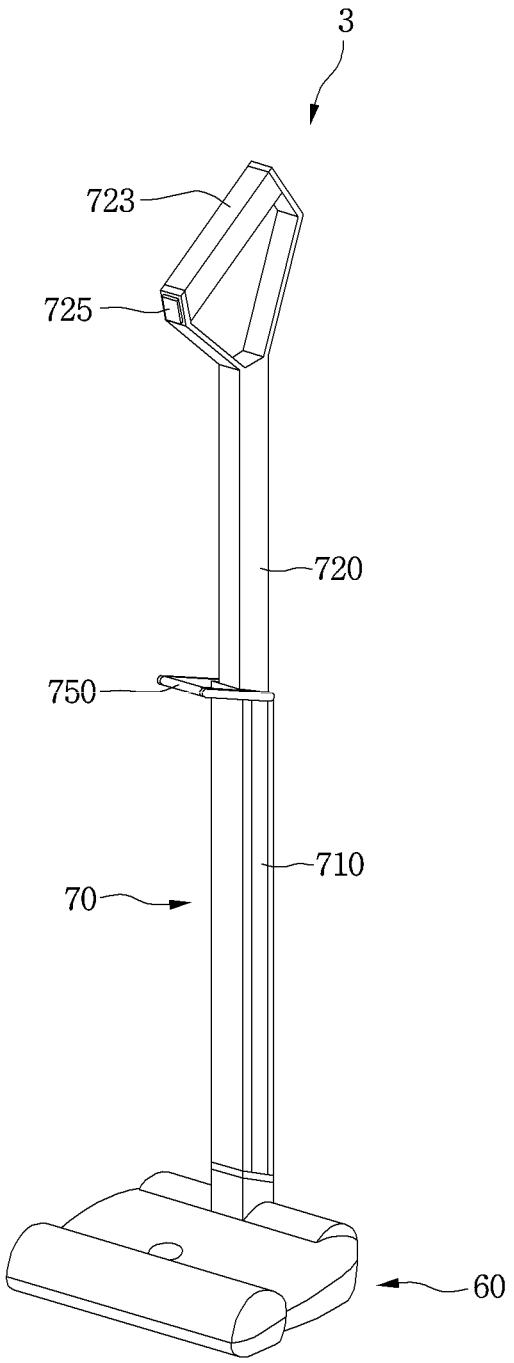
FIG. 32 is a perspective view of a cleaning apparatus according to a third embodiment.
Figure 33:
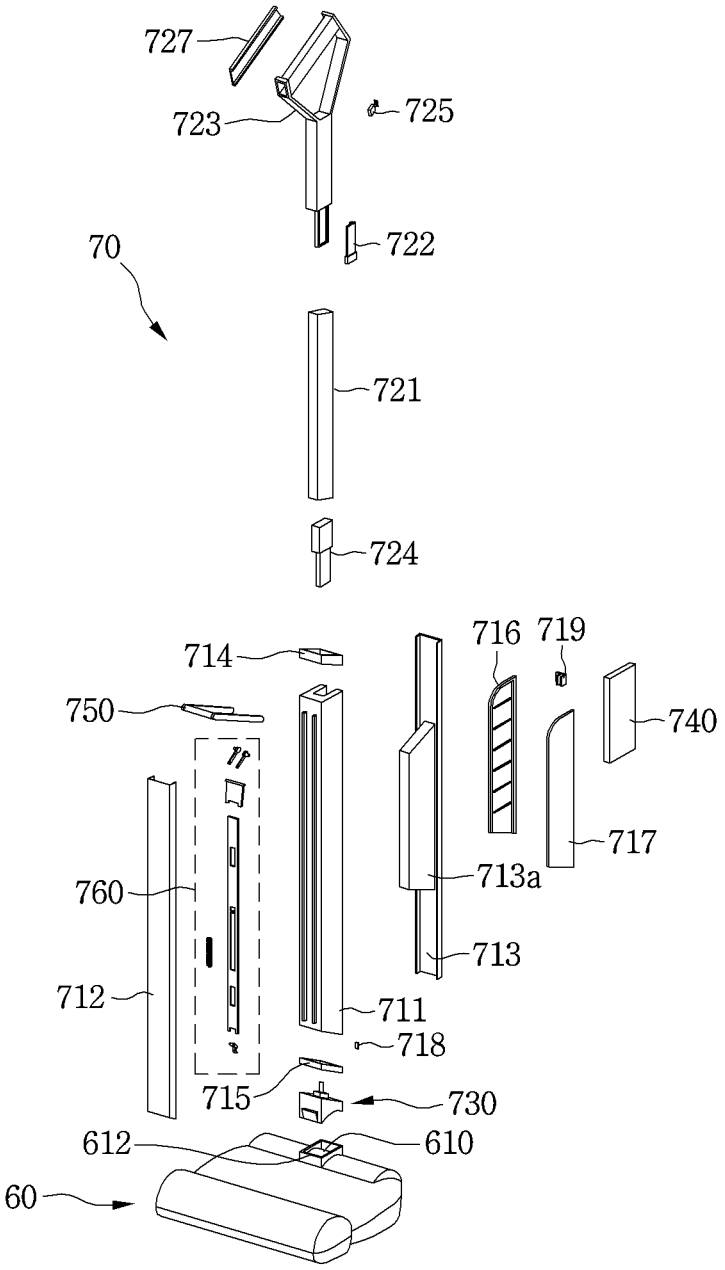
FIG. 33 is an exploded perspective view of the cleaning apparatus of FIG. 32.

FIG. 32 is a perspective view of a cleaning apparatus 3 according to a third embodiment. FIG. 33 is an exploded perspective view of the cleaning apparatus 3 of FIG. 32.

Referring to FIGS. 32 and 33, the cleaning apparatus 3 may include a cleaning unit 60 able to automatically move and a stick unit 70 able to be separably coupled with the cleaning unit 60.

The cleaning unit 60 may correspond to the first cleaning unit 30 in the second embodiment.

Accordingly, since all descriptions of the first cleaning unit 30 in the second embodiment may be identically applied to the cleaning unit 60 in the third embodiment, a detailed description thereof will be omitted. Hereinafter, only particular features of the third embodiment will be described.

The stick unit 70 may include stick bodies 710 and 720 and a handle 723 provided at one side of the stick bodies 710 and 720.

The stick bodies 710 and 720 may include a first body 710 and a second body 720 movably connected to the first body 710.

Below the second body 720, the first body 710 may be connected. Above the second body 720, the handle 723 may be connected.

The second body 720 may include a body portion 721, a first connecting portion 722 provided above the body portion 721 and connected to the handle 723, and a second connecting portion 724 provided below the body portion 721 and connected to the first body 710.

The handle 723 may include an input portion 725 for inputting an operation command for the cleaning unit 60 and a handle cover 727.

The stick unit 70 may further include a second battery 740 for supplying power to internal electronic components or the cleaning unit 60. The second battery 740 may be provided at the first body 710 but is not limited thereto.

Figure 35:
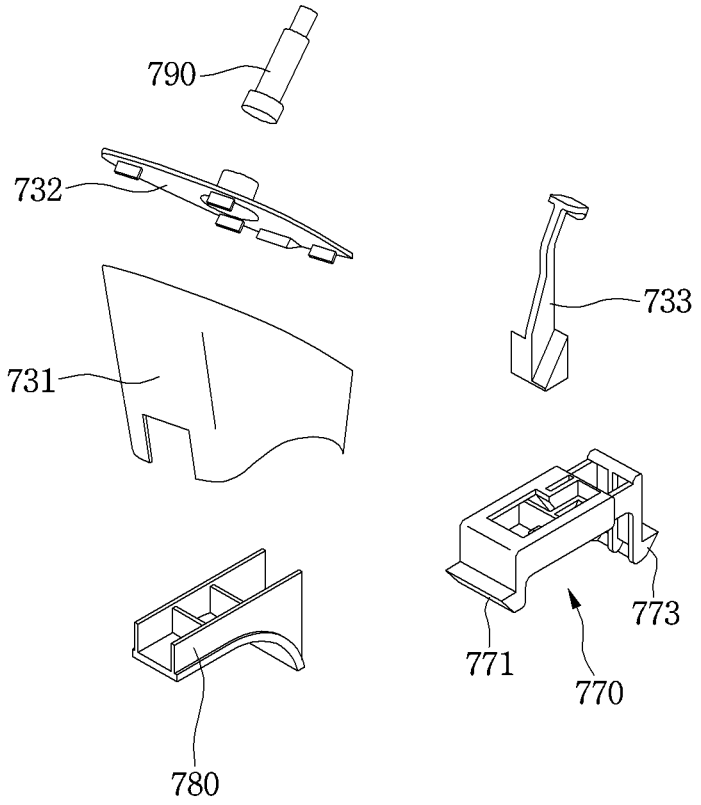
FIG. 35 is an exploded perspective view of a connecting body shown in FIG. 33.

The stick unit 70 may further include an operation portion 750 operable to separate the stick unit 70 from the cleaning unit 60 and a power transfer portion 760 for transferring an operation force of the operation portion 750 to a second coupling portion 770 (refer to FIG. 35).

The power transfer portion 760, for example, may be provided on the first body 710. The power transfer portion 760 will be described below in detail with reference to FIG. 34.

The stick unit 70 may further include a connecting body 730 connected to the cleaning unit 60. The connecting body 730 may be pivotably connected to a bottom of the first body 710. The connecting body 730 will be described below in detail with reference to FIG. 35.

The first body 710 may include a main frame 711, a front cover 712, a rear cover 713, a top cover 714, and a bottom cover 715.

The main frame 711 may accommodate the second body 720.

Also, to a front portion of the main frame 711, the operation portion 750 and the power transfer portion 760 may be connected.

The front cover 712 may be provided on the front portion of the main frame 711, and the rear cover 713 may be provided on a rear portion of the main frame 711.

The front cover 712 may cover the power transfer portion 760 and may form an exterior of the first body 710.

The rear cover 713 may include a battery accommodating portion 713*a* in which the second battery 740 is accommodated.

The first body 710 may further include battery covers 716 and 717 provided at the rear cover 713. The battery covers 716 and 717 may be provided inside the rear cover 713.

The top cover 714 may cover a top of the main frame 711. The top cover 714 may have a partially open shape to allow the second body 720 to pass therethrough.

The bottom cover 715 may cover a bottom of the main frame 711. The bottom cover 715 may have a partially open shape to allow the connecting body 730 to be partially inserted.

The stick unit 70 may further include a pivoting limiting portion 718 to limit the horizontal pivoting of the stick unit 70 in a state in which the stick unit 70 is connected to the cleaning unit 60 and stands straight.

The pivoting limiting portion 718 may be provided in the main frame 711. The pivoting limiting portion 718 may be guided by a limiting guide 732 (refer to FIG. 35) that will be described below. Since the pivoting limiting portion 718 corresponds to the pivoting limiting portion 492 in the second embodiment, a detailed description thereof will be omitted.

The stick unit 70 may further include an operation limiting portion 719 which limits the operation of the operation portion 750 when the stick unit 70 pivots downward at a certain angle from a state in which the stick unit 40 is connected to the cleaning unit 60. Since the operation limiting portion 719 corresponds to the operation limiting portion 494 in the second embodiment, a detailed description thereof will be omitted.

Figure 34:
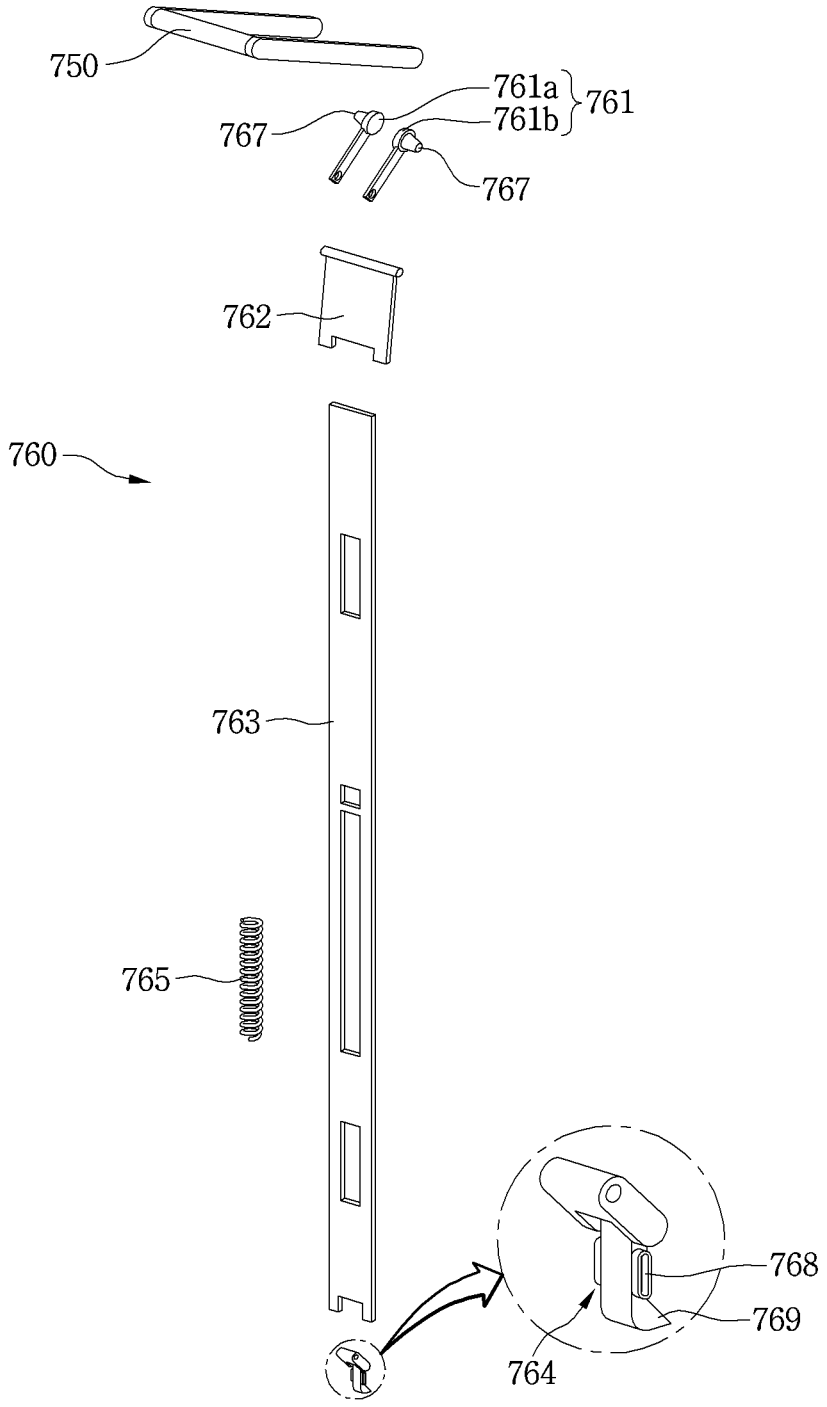
FIG. 34 is an exploded perspective view of an operation portion and a power transfer portion shown in FIG. 33.

FIG. 34 is an exploded perspective view of the operation portion 750 and the power transfer portion 760 shown in FIG. 33.

Referring to FIG. 34, the operation portion 750 may be connected to a top of the power transfer portion 760

As the operation portion 750 pivots upward, the power transfer portion 760 moves upward, thereby transferring power to the connecting body 730.

The power transfer portion 760 may include a plurality of links 761, 762, and 763.

The plurality of links 761, 762, and 763 may be arranged in a vertical direction while being mutually pivotably connected by hinges.

The power transfer portion 760 may further include a first connector 764 connected to the plurality of links 761, 762, and 763.

The first connector 764 may transfer the power transferred through the operation portion 750 to the connecting body 730.

The power transfer portion 760 may be connected to one of the plurality of links 761, 762, and 763. An elastic member 765 may be further included. One end of the elastic member 765 may be connected to one of the plurality of links 761, 762, and 763, and the other end of the elastic member 765 may be connected to the main frame 711.

The elastic member 765 may elongate as the plurality of links 761, 762, and 763 ascend. Here, the elastic member 765 may provide an elastic force for the plurality of links 761, 762, and 763 so that the plurality of links 761, 762, and 763 may move downward.

Accordingly, the plurality of links 761, 762, and 763 may return to original positions due to the elastic force of the elastic member 765 even when being lifted by the operation portion 750.

The plurality of links 761, 762, and 763 may include a first link 761 to which the operation portion 750 is connected. The operation portion 750 may be fixed to one side of the first link 761.

The first link 761 may include a hinge axis 767 connected to the main frame 711. Accordingly, the first link 761 may vertically pivot on one point of the main frame 711.

Meanwhile, the operation portion 750 may be connected to the hinge axis 767. Accordingly, the operation portion 750 and the first link 761 may pivot together on the hinge axis 767.

As shown in the drawing, the first link 761 may include a plurality of links 761*a* and 761*b* but is not limited thereto.

The plurality of links 761, 762, and 763 may further include a second link 762 pivotably connected to a bottom of the first link 761 and a third link 763 pivotably connected to a bottom of the second link 762.

To a bottom of the third link 763, the first connector 764 may be pivotably connected by a hinge.

The first connector 764 may include a guide slot 768 to guide a vertical movement of the first connector 764 and a first connecting hook 769. Although not shown in the drawings, the guide slot 768 may accommodate a guide protrusion included in the first body 710.

FIG. 35 is an exploded perspective view of the connecting body 730 shown in FIG. 33.

Referring to FIG. 35, a lower body 780 in contact with the cleaning unit 60 may be provided below the connecting body 730 and a shaft 790 may be provided above the connecting body 730. The connecting body 730 may be relatively-pivotably connected to the first body 710 by the shaft 790.

The connecting body 730 may include a body portion 731, the limiting guide 732, a second connector 733, and the second coupling portion 770.

The limiting guide 732 may be provided above the body portion 731 and may operate with the pivoting limiting portion 718.

When the stick unit 70 is allowed to stand straight while being coupled with the cleaning unit 60, the pivoting limiting portion 718 is accommodated in an accommodating groove 732*a* (refer to FIG. 36) provided in the limiting guide 732.

The second connector 733 may selectively receive an operation force of the operation portion 750 from the first connector 764.

The second connector 733 is connected to the second coupling portion 770. The second coupling portion 770 may include a first coupling body 771 and a second coupling body 773 movably connected to the first coupling body 771.

When the second connector 733 receives the operation force of the operation portion 750 from the first connector 764, the second connector 733 moves upward. Due to the upward movement of the second connector 733, the first coupling body 771 and the second coupling body 773 may move in a horizontal direction. For example, the respective coupling bodies 771 and 773 may move in directions to become closer to each other.

Since the second connector 733 and the second coupling portion 770 have the same configuration as those of the second connector 460 and the second coupling portion 470 in the second embodiment, hereinafter, a detailed description thereof will be omitted.

Merely, positions of the second connector 733 and the second coupling portion 770 may differ from positions of the second connector 460 and the second coupling portion 470.

Figure 36:
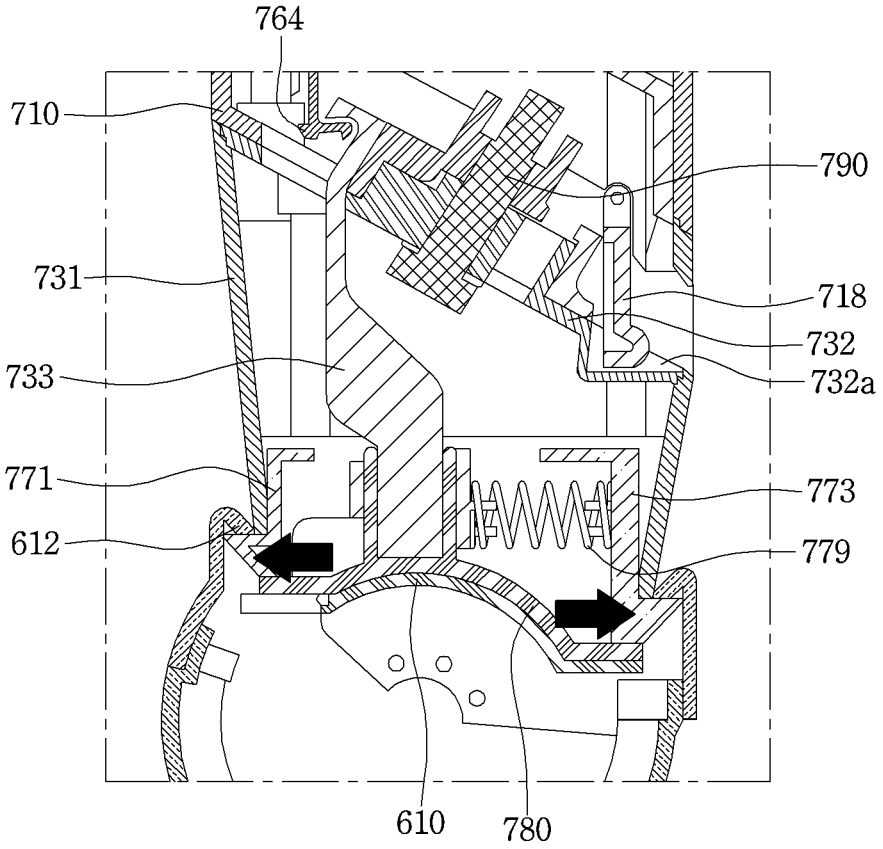
FIG. 36 is a view illustrating a state in which a stick unit is coupled with a cleaning unit according to the third embodiment.
Figure 37:
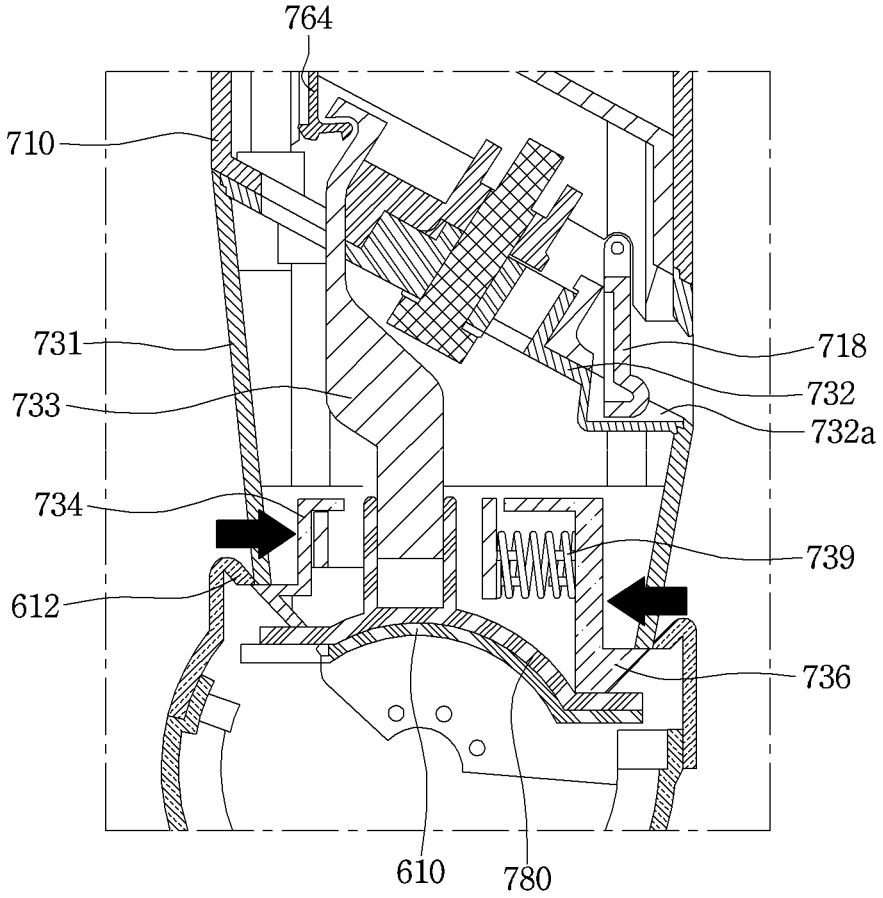
FIG. 37 is a view illustrating a state in which the stick unit is released from the cleaning unit according to the third embodiment.
Figure 38:
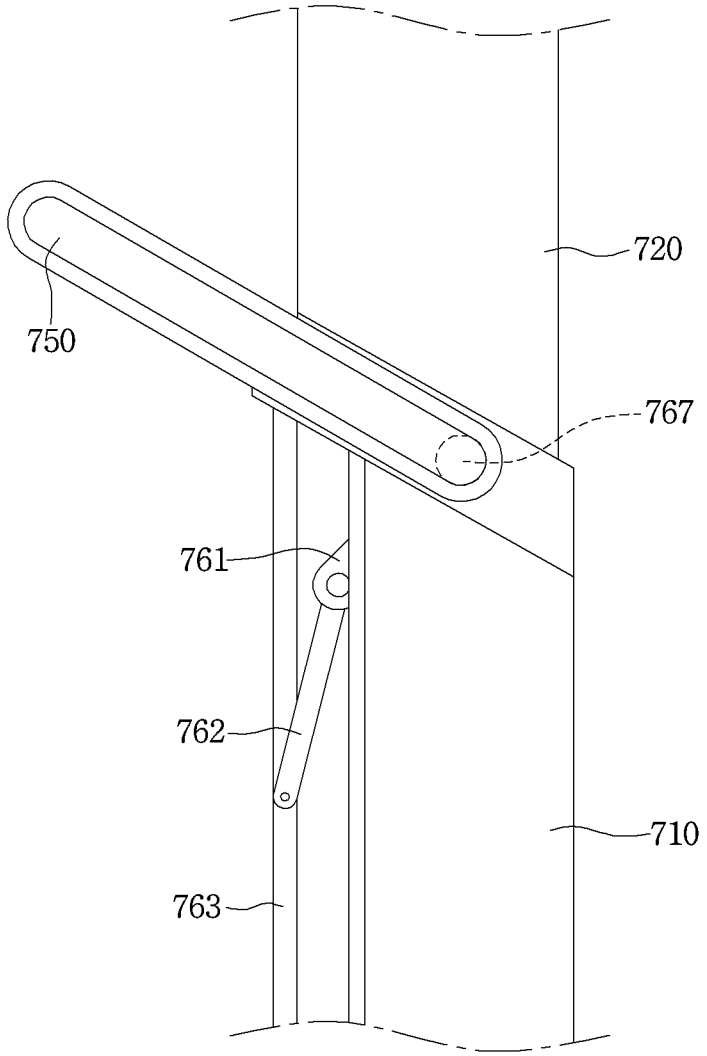
FIG. 38 is a view illustrating a position of the operation portion in the state in which the stick unit is coupled with the cleaning unit according to the third embodiment.
Figure 39:
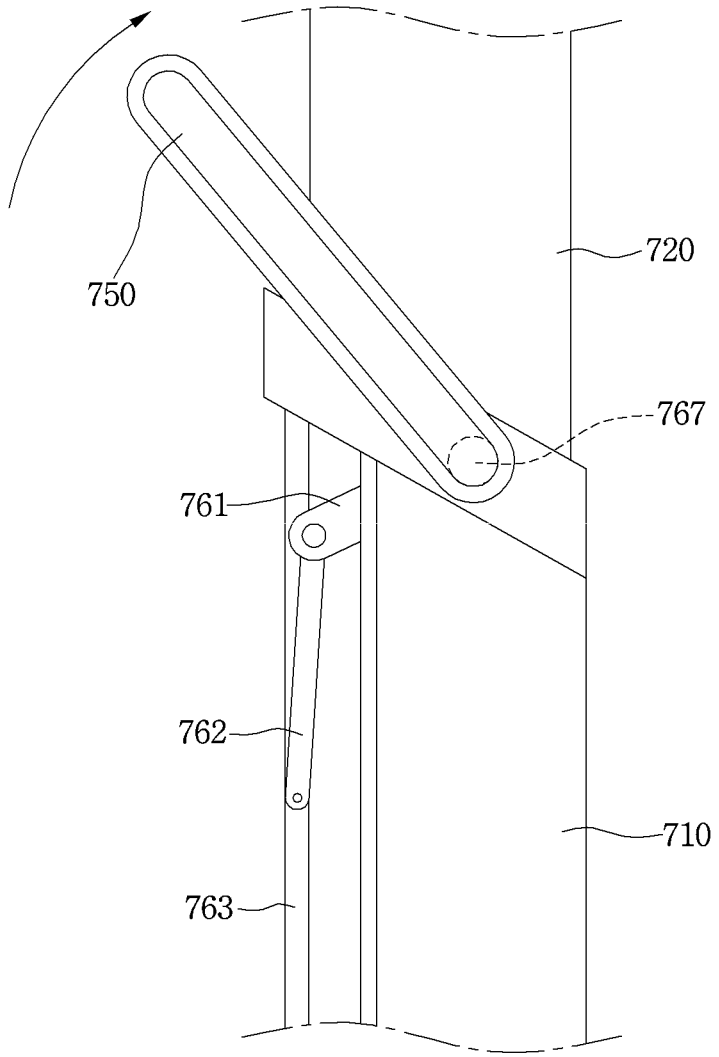
FIG. 39 is a view illustrating a position of the operation portion in the state in which the stick unit is released from the cleaning unit according to the third embodiment.

FIG. 36 is a view illustrating a state in which the stick unit 70 is coupled with the cleaning unit 60 according to the third embodiment. FIG. 37 is a view illustrating a state in which the stick unit 70 is released from the cleaning unit 60 according to the third embodiment. FIG. 38 is a view illustrating a position of the operation portion 750 in the state in which the stick unit 70 is coupled with the cleaning unit 60 according to the third embodiment. FIG. 39 is a view illustrating a position of the operation portion 750 in the state in which the stick unit 70 is released from the cleaning unit 60 according to the third embodiment.

Referring to FIGS. 36 to 39, when the stick unit 70 is coupled with the cleaning unit 60, the second coupling portion 770 may be coupled with a first coupling portion 612 of the cleaning unit 60. Here, the lower body 780 may be connected to a connecting member 610 of the cleaning unit 60.

The first coupling body 771 and the second coupling body 773 may be elastically supported by an elastic member 779. The elastic member 779 provides an elastic force for the respective coupling bodies 771 and 773 to maintain a state in which the second coupling portion 770 is coupled with the first coupling portion 612 of the cleaning unit 60.

Here, the operation portion 750 may be maintained being moved downward.

Meanwhile, the user may release coupling between the stick unit 70 and the cleaning unit 60 by pivoting the operation portion 750 upward.

In detail, when the operation portion 750 pivots upward, the first link 761 of the power transfer portion 760 pivots upward on the hinge axis 767 and the second link 762 and the third link 763 may ascend due to the pivoting of the first link 761.

Due to the ascending of the third link 763, the first connector 764 connected to the third link 763 may move upward and may lift the second connector 733.

As the second connector 733 ascends, the first coupling body 771 and the second coupling body 773 move in directions to become closer to each other. Accordingly, coupling between the first coupling portion 612 and the second coupling portion 770 may be released.

Accordingly, according to the embodiment, due to the operation portion 750, the power transfer portion 760, and the second coupling portion 770, the cleaning unit 60 and the stick unit 70 may be easily coupled or separated.

A cleaning apparatus according to the embodiment may include a cleaning unit which includes a suction force generating device and a stick unit which is separably coupled with the cleaning unit and allows the cleaning unit to move in a state of being gripped by a user. The cleaning unit may include a transport device which may allow the cleaning unit to automatically move while the stick unit is separated and may be stopped when the stick unit is connected to the cleaning unit.

The transport device may include a plurality of wheels and a plurality of motors for driving the plurality of wheels, respectively.

A lifting device for spacing the plurality of wheels apart from a floor surface while the stick unit is connected to the cleaning unit may be further included.

When the stick unit pivots at a certain angle or more while being connected to the cleaning unit, the lifting device may lift the plurality of wheels.

The transport device may be connected to the cleaning unit to be rotatable on an axis, and the lifting device may include a connecting member to which the stick unit is connected and a moving portion which receives a rotating force of the connecting member and rotates the transport device upward on the axis.

The transport device may further include a power transfer device for transferring the power of the plurality of motors to the plurality of wheels, respectively, and the moving portion may rotate the power transfer device upward on the axis.

The connecting member may include a protrusion for being connected to the moving portion, and the moving portion may accommodate the protrusion and may include a plurality of slots to allow the protrusion to move.

The plurality of slots may include a first slot having an arc shape and a second slot which linearly extends from one end of the first slot.

The moving portion may slide due to the protrusion when the protrusion is located in the second slot. The moving portion may rotate the power transfer device upward on the axis when the protrusion moves to a borderline area between the second slot and the first slot. The moving portion may maintain a stationary state while the protrusion is moving along the first slot.

The cleaning unit may further include a plurality of auxiliary wheels for being in contact with the floor surface to move the cleaning unit when the plurality of wheels are spaced apart from the floor surface.

The plurality of auxiliary wheels may be provided three or more. At least two of the three or more auxiliary wheels may be spaced apart forward and backward.

The stick unit may include an input portion for inputting an operation command for the cleaning unit.

The cleaning unit may include a first battery, and the stick unit may include a second battery for supplying power to the cleaning unit.

When the stick unit is connected to the cleaning unit, the first battery and the second battery may be connected in series.

The stick unit may further include a coupling portion coupled with the cleaning unit and stick bodies pivotable on a hinge axis provided at the coupling portion.

A control portion which may recognize whether the stick unit is connected to the cleaning unit may be further included. When the control portion recognizes a separation state of the stick unit and the cleaning unit, the control portion may control the transport device to operate. When the control portion recognizes a connection state of the stick unit and the cleaning unit, the control portion may control the transport device to stop.

A cleaning apparatus according to another aspect may include a cleaning unit including a suction force generating device and a transport device for automatically moving and a stick unit separably coupled with the cleaning unit and able to move the cleaning unit when being gripped by a user. The stick unit may include a battery for supplying power to the suction force generating device.

The cleaning unit may include a battery for supplying power to the suction force generating device. When the stick unit is connected to the cleaning unit, the battery of the stick unit and the battery of the cleaning unit may be connected in series.

A cleaning apparatus according to still another aspect may include a stick unit which is coupled with a cleaning unit and able to move the cleaning unit in a state of being gripped by a user, a coupling portion provided at a bottom of the stick unit and separably coupled with the cleaning unit, an operation portion operable to separate the coupling portion from the cleaning unit, and a power transfer portion for transferring an operation force of the operation portion to the coupling portion.

The stick unit may further include a connecting body including the coupling portion and a stick body pivotably connected to a top of the connecting body.

A shaft which connects the connecting body with the stick body may be further included. The connecting body and the stick body may relatively pivot on the shaft.

A pivoting limiting portion provided at the stick unit and a limiting guide provided at the connecting body may be further included. A range of the relative pivoting of the coupling portion and the stick unit may be limited by an interaction between the pivoting limiting portion and the limiting guide.

The power transfer portion may include a hinge axis pivotably connected to the stick unit. The operation portion may be connected to the hinge axis. When the operation portion pivots upward, the power transfer portion pivots upward on the hinge axis and the coupling portion may be released from the cleaning unit due to the power transferred from the power transfer portion.

A first connector is provided in the power transfer portion and a second connector is connected to the coupling portion and able to selectively receive the operation force of the operation portion from the first connector may be further included. When the second connector is lifted by the first connector, the coupling portion may be released from the cleaning unit.

The stick unit may include a guide protrusion for guiding the movement of the first connector. The first connector may include a guide slot in which the guide protrusion is accommodated.

The coupling portion may include a first coupling body and a second coupling body movably connected to the first coupling body. The first coupling body and the second coupling body may be mounted on the cleaning unit, respectively. When the second connector is moved upward by the first connector, the first coupling body and the second coupling body may move in directions to become closer to each other.

An elastic member whose one side is connected to the first coupling body and whose other side is connected to the second coupling body may be further included. The elastic member may provide an elastic force in directions to allow the first coupling body and the second coupling body to become farther from each other to maintain a state in which the first coupling body and the second coupling body are coupled with the cleaning unit.

The power transfer portion may include a plurality of links. The respective links may be hinge-coupled with one another to be relatively pivotable.

An elastic member whose one side is connected to the stick unit and whose other side is connected to the power transfer portion may be further included. The elastic member may provide an elastic force to the power transfer portion downward to maintain a coupling state of the connecting portion and the cleaning unit.

The stick unit may include a first body connected to the connecting body and a second body slidably coupled with the first body.

The stick unit may further include a handle to be gripped by the user.

An operation limiting portion provided in the stick unit to selectively limit the operation of the operation portion may be further included.

A lower body provided at the stick unit and in contact with the cleaning unit may be further included.

A hand type cleaning unit which is separably connected to the stick unit and includes a suction motor and a battery may be further included.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaning apparatus comprising:

a cleaning unit including a power consumption unit and a first coupling portion;

a transport device for automatically moving the cleaning unit, and a stick unit able to be coupled to the cleaning unit and which allows the cleaning unit to move when gripped by a user, wherein the stick unit comprises:

a second coupling portion able to be coupled with the first coupling portion;

an operation portion operable to separate the second coupling portion from the first coupling portion; and a power transfer portion for transferring an operation force of the operation portion to the second coupling portion, wherein the transport device comprises a wheel and a motor for driving the wheel, wherein the motor operates to allow the cleaning unit to automatically move when the stick unit is separated from the cleaning unit, and wherein the motor maintains a stationary state when the stick unit is connected to the cleaning unit.

2. The cleaning apparatus of claim 1, wherein the power consumption unit comprises a suction force generating device for generating a suction force.

3. The cleaning apparatus of claim 2, wherein the cleaning unit further comprises a first battery for supplying power to the suction force generating device, wherein the stick unit further comprises a second battery for supplying power to the suction force generating device while being connected to the cleaning unit, and wherein the second battery is connected to the first battery in series when the stick unit is connected to the cleaning unit.

4. The cleaning apparatus of claim 2, wherein the stick unit further comprises a hand type cleaning unit comprising a suction motor and a battery which supplies power to the suction motor.

5. The cleaning apparatus of claim 4, wherein when the stick unit is coupled with the cleaning unit, and wherein power of the battery is able to be supplied to the suction force generating device of the power consumption unit.

6. The cleaning apparatus of claim 1, further comprising a lifting device for spacing the wheel apart from a floor surface when the stick unit is connected to the cleaning unit, wherein the lifting device lifts the wheel when the stick unit pivots at a predetermined angle or more while connected to the cleaning unit.

7. The cleaning apparatus of claim 6, wherein the transport device is connected to the cleaning unit and able to rotate on a shaft, and wherein the lifting device comprises:

a connecting member to which the stick unit is connected; and a moving portion which receives a rotating force of the connecting member and rotates the transport device on the shaft.

8. The cleaning apparatus of claim 7, wherein the transport device further comprises a power transfer device for transferring power of the motor to the wheel, and wherein the moving portion rotates the power transfer device upward on the shaft.

9. The cleaning apparatus of claim 7, wherein the connecting member comprises a protrusion for being connected to the moving portion, wherein the moving portion comprises a plurality of slots to allow the protrusion to move, and wherein the plurality of slots comprise:

a first slot having an arc shape; and a second slot which linearly extends from one end of the first slot.

10. The cleaning apparatus of claim 9, wherein the moving portion slides due to the protrusion when the protrusion is located in the second slot, wherein the moving portion rotates the power transfer device upward on the shaft when the protrusion moves to a borderline area between the second slot and the first slot, and wherein the moving portion maintains a stationary state while the protrusion is moving along the first slot.

11. The cleaning apparatus of claim 6, wherein the cleaning unit further comprises a plurality of auxiliary wheels for contacting with the floor surface to move the cleaning unit when the wheel is spaced apart from the floor surface.

12. The cleaning apparatus of claim 1, wherein the stick unit further comprises:

a connecting body including the second coupling portion, and a stick body pivotably connected to the connecting body.

13. The cleaning apparatus of claim 12, further comprising a shaft to connect the connecting body to the stick body, wherein the connecting body and the stick body pivot on the shaft.

14. The cleaning apparatus of claim 13, further comprising:

a pivoting limiting portion at the stick body; and a limiting guide at the connecting body, wherein a range of the pivot of the connecting body and the stick body is limited by an interaction between the pivoting limiting portion and the limiting guide.

15. The cleaning apparatus of claim 1, wherein the power transfer portion comprises:

a link connected to the operation portion;

a first connector which receives power from the link; and a second connector which receives power from the first connector and transfers the power to the second coupling portion.

16. The cleaning apparatus of claim 15, wherein the second coupling portion comprises a first coupling body and a second coupling body movably connected to the first coupling body, and wherein when the second connector is moved by the first connector, the first coupling body and the second coupling body move in directions closer to each other to release a coupling between the second coupling portion and the first coupling portion.

17. The cleaning apparatus of claim 16, further comprising an elastic member to provide an elastic force for the first coupling body and the second coupling body in directions to allow the first coupling body and the second coupling body to become farther from each other to maintain a state in which the first coupling body and the second coupling body are coupled with the first coupling portion.

18. The cleaning apparatus of claim 1, wherein the stick unit further comprises an operation limiting portion to selectively limit an operation of the operation portion.

19. The cleaning apparatus of claim 18, wherein the stick unit further comprises a through hole for providing a path for a movement of the operation portion, and wherein when the stick unit pivots at a predetermined angle or more from the cleaning unit while connected to the cleaning unit, the operation limiting portion is located in the through hole to limit the operation of the operation portion.

* * * * *